US005192656A

United States Patent [19]

Nishikawa et al.

[11] Patent Number: 5,192,656

[45] Date of Patent: * Mar. 9, 1993

[54] SILVER HALIDE COLOR PHOTOGRAPHIC LIGHT-SENSITIVE MATERIAL

[75] Inventors: Toshihiro Nishikawa; Shinji Ueda; Hideo Usui, all of Minami-Ashigara, Japan

[73] Assignee: Fuji Photo Film Co., Ltd., Minami-Ashigara, Japan

[ * ] Notice: The portion of the term of this patent subsequent to Mar. 14, 2006 has been disclaimed.

[21] Appl. No.: 181,096

[22] Filed: Apr. 13, 1988

[30] Foreign Application Priority Data

Apr. 15, 1987 [JP] Japan ..... 62-92371

[51] Int. Cl.[5] ..... G03C 1/005

[52] U.S. Cl. ..... 430/627; 430/527; 430/631

[58] Field of Search ..... 430/631, 627, 527, 528

[56] References Cited

U.S. PATENT DOCUMENTS

| | | | |
|---|---|---|---|
| 3,660,142 | 5/1972 | Kasugai et al. | 430/631 |
| 3,811,889 | 5/1974 | Endou et al. | 430/631 |
| 4,006,025 | 2/1977 | Swank et al. | 430/631 |
| 4,126,467 | 11/1978 | Miyazoko et al. | 430/631 |
| 4,251,626 | 2/1981 | Minamizono et al. | 430/631 |
| 4,330,618 | 5/1982 | Minamizono et al. | 430/631 |
| 4,362,812 | 12/1982 | Minamizono et al. | 430/631 |
| 4,374,924 | 2/1983 | Yokoyama et al. | 430/631 |
| 4,513,080 | 4/1985 | Helling | 430/631 |
| 4,622,288 | 11/1986 | Yokoyama et al. | 430/631 |
| 4,812,391 | 3/1989 | Toyo et al. | 430/564 |

FOREIGN PATENT DOCUMENTS 62-19842 1/1987 Japan .

*Primary Examiner*—Jack P. Brammer

*Attorney, Agent, or Firm*—Burns, Doane, Swecker & Mathis

[57] ABSTRACT

A silver halide color photographic light-sensitive material comprises at least one silver halide emulsion layer applied onto a substrate, at least one of the layers being formed from a silver halide emulsion containing not less than 7 mole % of silver iodide and the light-sensitive material including a polymer having cationic sites. The light-sensitive material exhibits good graininess, high sensitivity and excellent desilvering properties.

8 Claims, No Drawings

SILVER HALIDE COLOR PHOTOGRAPHIC LIGHT-SENSITIVE MATERIAL

BACKGROUND OF THE INVENTION (1) Field of the Invention

The present invention relates to silver halide color photographic light-sensitive materials and more particularly to silver halide color photographic light-sensitive materials having good graininess, high sensitivity and excellent desilvering properties.

(2) Prior Art

It has generally been known that a silver halide color photographic light-sensitive material exhibiting excellent graininess and high sensitivity can be obtained by increasing the iodine content of the silver halide. However, it is also known that various troubles arise associated with the continuous processing of such light-sensitive material of which iodine content is increased. That is, although color development generally comprises color developing process, desilvering process and water washing-stabilization process, it is required in the desilvering process to remove all the silver halides contained in the light-sensitive material and elemental silver formed during development (hereunder referred to as "developed silver"), and, in the case of such a light-sensitive material, a great amount of iodide ions is accumulated in the desilvering process, which leads to greatly lower desilvering properties thereof.

Furthermore if bleaching-fixing treatment is employed as the desilvering process, not only the fixing ability but also the bleaching ability thereof are lowered as iodide ions are accumulated in the bleaching-fixing process. Generally, to the bleaching-fixing bath, there is added a bleaching accelerator such as various mercapto compounds as disclosed in U.S. Pat. No. 3,893,858; U.K. Patent No. 1,138,842 and Japanese Patent Unexamined Published Application (hereinafter referred to as "J.P. KOKAI") No. 53-141623; compounds having disulfide bonds as disclosed in J.P. KOKAI No. 53-95630; thiazolidine derivatives as disclosed in Japanese Patent Publication for Opposition Purpose (hereinafter referred to as "J.P. KOKOKU") No. 53-9854; isothiourea derivatives as disclosed in J.P. KOKAI No. 53-94927; thiourea derivatives as disclosed in J.P. KOKOKU Nos. 45-8506 and 49-26586; thioamide compounds as disclosed in J.P. KOKAI No. 49-42349; dithiocarbamates as disclosed in J.P. KOKAI No. 55-26506; or arylene diamine compounds as disclosed in U.S. Pat. No. 4,552,834. However, the bleaching ability of the bleaching-fixing bath in which lots of iodide ions are accumulated cannot be recovered sufficiently even if such a bleaching accelerator is added.

On the other hand, as a means for removing bromide ions accumulated in a color developer so as to stably hold the developing activity of such a developer, for instance, J.P. KOKAI No. 61-56345 discloses that in a color photographic light-sensitive material having light-sensitive silver halide emulsion layers containing silver chlorobromide, a cation exchange resin or an onium compound is added to non-light-sensitive layers thereof disposed on the side of a substrate opposite to that having the light-sensitive layers.

However, the light-sensitive material according to the above-described methods is inferior in graininess and sensitivity compared with those containing silver iodide because the silver chlorobromide is used as light-sensitive silver halides. In addition, this method has no problem of desilvering properties because silver iodide is not used.

SUMMARY OF THE INVENTION

Accordingly, it is a primary purpose of the present invention to provide a silver halide color photographic light-sensitive material exhibiting excellent graininess, high sensitivity and good desilvering properties.

The inventors of this invention have conducted various studies to eliminate the disadvantages associated with the conventional silver halide color light-sensitive materials and have found that the drawbacks can effectively be eliminated by adding polymer which has cationic sites to silver halide color photographic light-sensitive materials comprising at least one silver halide emulsion layer containing a specific amount of silver iodide and thus have completed the present invention on the basis of such a finding.

According to present invention, there is provided a silver halide color photographic light-sensitive material comprising at least one silver halide emulsion layer applied onto a substrate, at least one of the layers being formed from silver halide emulsion containing not less than 7 mole % of silver iodide, the light-sensitive material comprising polymer which has cationic sites.

DESCRIPTION OF THE PREFERRED INVENTION

Silver halide grains used in the color photographic light-sensitive material of the invention may be so-called regular grains having a regular crystal form such as cubic, octahedron, dodecahedron and tetradecahedron, alternatively, the grains may be of an irregular crystal structure such as spherical or plate crystalline form or the grains may be a composite form of these crystal forms. Moreover, the grains may be plate crystal having an aspect ratio of not less than 5 such as those disclosed in Research Disclosure, Vol. 225, pp 20–58 (Jan. 1983).

The grains may also be epitaxial structure or grains having a multi-layered structure in which the compositions (for instance, composition of halogen) are different between the outer part and the inner part thereof.

The average grain size is preferably not less than 0.5 microns and more preferably not less than 0.7 microns and not more than 5.0 microns.

The grain size distribution may be either wide or narrow. The silver halide grains having a narrow grain size distribution are known and used to form so-called monodisperse emulsions. Preferred such monodisperse emulsions are those having a dispersion coefficient of not more than 20%, more preferably not more than 15%. In this connection, the term "dispersion coefficient" is defined as the standard deviation divided by average grain size.

These photographic emulsions can be prepared by the methods disclosed in the following articles: P. Glafkides, Chimie et Physique Photographique, 1967, Paul Montel; G. F. Duffin, Photographic Emulsion Chemistry, 1966, The Focal Press; V. L. Zelikam et al., Making and Coating Photographic Emulsion, 1964, The Focal Press. More specifically the emulsions may be prepared by acid method, neutral method or ammonia method and the reaction of a soluble silver salt and a soluble halide may be carried out by the single-jet method, the double-jet method or combination thereof.

In these photographic emulsions, silver halide may be any combinations of silver chloride, silver bromide, silver iodide, silver iodobromide, silver chloroiodobromide and/or silver chlorobromide, provided that the light-sensitive material of the present invention must comprise at least one silver halide emulsion layer containing not less than 7 mole %, preferably 7 to 25 mole %, more preferably 10 to 20 mole % of silver iodide.

Therefore, the light-sensitive material of the invention is produced by applying, onto a substrate, at least one silver halide emulsion prepared by using at least one silver halide selected from the group consisting of silver iodide, silver iodobromide, silver chloroiodobromide and silver chloroiodide. In this respect, other silver halide such as silver chloride and silver bromide may optionally be used in addition to the foregoing silver iodide. The emulsion containing not less than 7 mole % of silver iodide is preferably used to form red-sensitive silver halide emulsion layers. Further, it is preferred that all the silver halide emulsion layers, i.e. red-sensitive, green-sensitive and blue-sensitive emulsion layers have a silver iodide content of not less than 7 mole %. In the case where each sensitive emulsion layer comprises at least two layers, all such layers preferably contain at least 7 mole % of silver iodide.

The coated amount of the light-sensitive material (expressed as the amount of elemental silver) of the invention is preferably 1 to 20g/m$^2$, in particular, 2 to 10 g/m$^2$, while the total amount of iodine (AgI) included in the silver halide light-sensitive material is preferably not less than $4\times10^{-3}$3 moles/m$^2$, more preferably $6\times10^{-3}$ to $4\times10^{-2}$ moles/m$^2$. Moreover, the amount of iodine is preferably not less than 1 mole %, more preferably 5 to 20 mole % on the basis of the total amount of the light-sensitive material.

Other compounds such as cadmium salts, zinc salts, thallium salts, iridium salts or complex salts thereof, rhodium salts or complex salts thereof and iron salts or complex salts thereof may be coexistent with the silver halide grains, during the formation of the latter or the aging step thereof.

Polymers which have cationic sites and are usable herein are those providing cationic sites during the developing process, particularly in a processing solution exhibiting fixing ability and are preferably anion exchange polymers. Examples of such anion exchange polymers are those having quaternary ammonium group (or phosphonium groups) and those which can be converted to cationic ones by the addition of, for instance, hydrogen ions in the processing solution, such as polymers of tertiary amino groups.

These polymers are known and disclosed in the following publications as mordant polymers or antistatic polymers: for instance, aqueous latex dispersions being disclosed in J.P. KOKAI Nos. 59-166940, 55-142339, 54-126027, 54-155835, 53-30328 and 54-92274 and U.S. Pat. No. 3,958,995; polyvinyl pyridinium salts in U.S. Pat. Nos. 2,548,564, 3,148,061 and 3,709,690; water-soluble polymers of ammonium salts in U.S Pat. No. 3,709,690; and water-insoluble polymers of ammonium salts in U.S. Pat. No. 3,898,088.

Preferred anion exchange polymers are those represented by the following general formula (I):

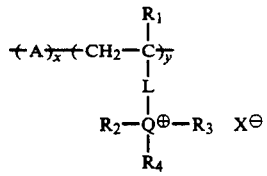

(I)

In the general formula (I), A represents an ethylenically unsaturated monomer unit, $R_1$ represents a hydrogen atom or a lower alkyl group having 1 to about 6 carbon atoms; L denotes a bivalent group having 1 to about 12 carbon atoms; $R_2$ to $R_4$ may be the same or different and each represents an alkyl group having 1 to about 20 carbon atoms, an aralkyl group having 7 to about 20 carbon atoms or a hydrogen atom with the proviso that $R_2$ to $R_4$ may form a ring together with Q, preferably only one of $R_2$ to $R_4$ being a hydrogen atom from the viewpoint of remaining color stain; Q represents N or P; X represents an anion other than iodide ion. In addition, x is 0 to about 90 mole %, and y is about 10 to 100 mole %.

Examples of ethylenically unsaturated monomers from which the substituent A is derived include olefins such as ethylene, propylene, 1-butene, vinyl chloride, vinylidene chloride, isobutene and vinyl bromide; dienes, such as butadiene, isoprene and chloroprene; ethylenically unsaturated esters of aliphatic acids or aromatic carboxylic acids, such as vinyl acetate, allyl acetate, vinyl propionate, vinyl butyrate and vinyl benzoate; esters of ethylenically unsaturated acids, such as methyl methacrylate, butyl methacrylate, tert-butyl methacrylate, cyclohexyl methacrylate, benzyl methacrylate, phenyl methacrylate, octyl methacrylate, amyl acrylate, 2-ethylhexyl acrylate, benzyl acrylate, dibutyl maleate, diethyl fumarate, crotonates and dibutyl ethylenemalonate; styrenes such as styrene, alpha-methylstyrene, vinyltoluene, chloromethylstyrene, chlorostyrene, dichlorostyrene and bromostyrene; unsaturated nitriles such as acrylonitrile, methacrylonitrile, allyl cyanide and crotonenitrile. Particularly preferred examples are styrenes and methacrylates because these are emulsion polymerizable and have good hydrophobic properties. The substituent A may also be derived from at least two of these monomers.

$R_1$ is preferably a hydrogen atom or a methyl group in taking the polymerizability thereof into consideration.

Preferred L is a bivalent group represented by the general formula —CO—O—$R_5$—, —CO—N($R_6$)—$R_5$— or —ph—$(CH_2)_n$; more preferably L represents —CO—N($R_6$)—$R_5$ or —ph—$(CH_2)_n$— in view of alkali resistance or the like and in particular, —ph—$CH_2$— is preferred from the viewpoint of emulsion polymerizability. In the foregoing formulas, $R_5$ represents an alkylene group such as methylene, ethylene, trimethylene or tetramethylene; an arylene group, an aralkylene group such as —ph—$R_7$— (where $R_7$ denotes an alkylene group having 0 to about 6 carbon atoms); $R_6$ represent a hydrogen arom or $R_2$; ph represents a phenylene group (the groups —$(CH_2)_n$ or —$CH_2$— may be bonded thereto at any position) and n is an integer of 1 or 2.

Q is preferably N in taking the toxicity into account. $X^-$ is an anion other than iodide ion and examples thereof include a halogen ion such as a chloride or bromide ion; an alkyl sulfate ion such as a methyl sulfate ion or an ethyl sulfate ion; an alkyl or aryl sulfonate ion such as a methane sulfonate, ethane sulfonate, benzene sulfonate or p-toluene sulfonate ion; a nitrate ion, an acetate ion or a sulfate ion. Among these, chloride, alkyl sulfate, aryl sulfate or sulfate ions are particularly preferred.

$R_2$ to $R_4$ each represents an alkyl or aralkyl group which may be substituted. Examples of alkyl groups include unsubstituted alkyl groups such as methyl, ethyl, propyl, isopropyl, tert-butyl, hexyl, cyclohexyl, 2-ethylhexyl and dodecyl groups; substituted alkyl groups such as alkoxyalkyl (e.g. methoxymethyl, methoxybutyl, ethoxyethyl, butoxyethyl and vinyloxyethyl groups), cyanoalkyl groups (e.g. 2-cyanoethyl and 3-cyanopropyl groups), halogenated alkyl groups (e.g. 2-fluoroethyl, 2-chloroethyl and perfluoropropyl groups), alkoxycarbonylalkyl groups (e.g. ethoxycarbonylmethyl group); allyl group, 2-butenyl group, and propargyl group.

Examples of aralkyl groups are unsubstituted aralkyl groups such as benzyl, phenethyl, diphenylmethyl, and naphthylmethyl groups; substituted aralkyl groups such as alkylaralkyl groups (e.g. 4-methylbenzyl, 2,5-dimethylbenzyl, 4-isopropylbenzyl and 4-octylbenzyl groups), alkoxyaralkyl groups (e.g. 4-methoxybenzyl, 4-pentafluoropropenyloxybenzyl and 4-ethoxybenzyl groups), cyanoaralkyl groups (e.g. 4-cyanobenzyl and 4-(4-cyanophenyl)-benzyl groups), and halogenated aralkyl groups (e.g. 4-chlorobenzyl, 3-chlorobenzyl and 4-bromobenzyl and 4-(4-chlorophenyl)-benzyl groups).

The preferred number of carbon atoms of alkyl groups is 1 to 12 and that of the aralkyl groups is 7 to 14.

Examples of rings formed from $R_2$ to $R_4$ together with Q are as follows:

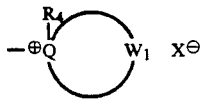

wherein $W_1$ represents a group required to form aliphatic heterocyclic ring together with Q. Examples of such aliphatic heterocyclic rings are as follows:

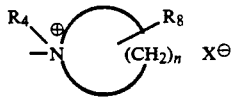

wherein $R_8$ represents a hydrogen atom or $R_4$ and n is an integer of 2 to 12;

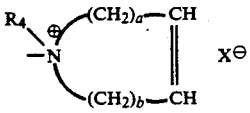

wherein the sum of a and b is an integer of 2 to 7;

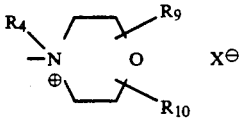

wherein $R_9$ and $R_{10}$ each represents hydrogen atom or a lower alkyl group having 1 to 6 carbon atoms; or

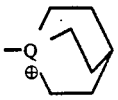

In addition to the aforementioned rings, preferred examples thereof also include the followings:

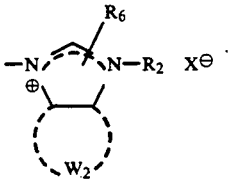

wherein $W_2$ represents a single bond or a group required to form a benzene ring;

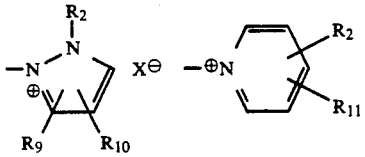

wherein $R_{11}$ represents —CO—O—$R_2$, —CO—$NR_2R_6$ or $R_2$, with the proviso that if there are two $R_2$, such two $R_2$ may be the same or different.

Among these ring structures, preferred are as follows:

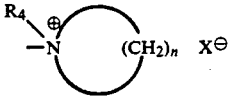

wherein n is an integer of 4 to 6; and

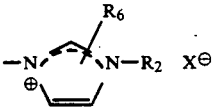

In the foregoing examples of rings, $R_2$, $R_4$, $R_6$, Q and $X^-$ each has the same meanings as defined above. In this connection, component y may be composed of at least two components. x is preferably 20 to 60 mole % while y is preferably 40 to 80 mole %.

In particular, these polymers are preferably used in the form of aqueous cross-linked polymer latex obtained by copolymerizing monomers having at least two, preferably 2 to 4 ethylenically unsaturated groups per molecule and then cross-linking to prevent the transfer thereof from the desired layer to other layers or processing solutions. Such transfer exerts photographically undesirable effects on the light-sensitive materials.

Preferred structures of such cross-linked polymer latex are those represented by the following general formula (II):

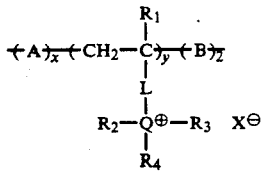

(II)

In the formula (II), A, $R_1$ to $R_4$, L and X are the same as those defined above associated with the formula (I). In the formula (II), y appearing is 10 to 99.9 mole %, preferably 10 to 95 mole %, x is 0 to about 90 mole % and z is 0.1 to 50 mole %, preferably 1 to 20 mole %. B represents a structural unit derived from copolymerizable monomers having at least two ethylenically unsaturated groups. Examples thereof are ethylene glycol dimethacrylate, diethylene glycol dimethacrylate, neopentyl glycol dimethacrylate, tetramethylene glycol dimethacrylate, pentaerythritol tetramethacrylate, trimethylolpropane trimethacrylate, ethylene glycol diacrylate, diethylene glycol diacrylate, neopentyl glycol diacrylate, tetramethylene glycol diacrylate, trimethylolpropane acrylate, allyl methacrylate, allyl acrylate, diallyl phthalate, methylene bisacrylamide, methylene bismethacrylamide, trivinylcyclohexane, divinylbenzene, N,N-bis(vinylbenzyl)-N,N-dimethyl ammonium chloride, N,N-diethyl-N-(methacryloyloxyethyl)-N-(vinylbenzyl) ammonium chloride, N,N,N',N'-tetraethyl-N,N'-bis(vinylbenzyl)-p-xylene diammonium dichloride, N,N'-bis(vinylbenzyl) triethylene diammonium dichloride, and N,N,N',N'-tetrabutyl-N,N'-bis(vinylbenzyl)-ethylene diammonium dichloride. Divinylbenzene and trivinylcyclohexane are particularly preferred ones because of their hydrophobic nature and alkali resistance.

Preferred examples of such polymers capable of providing cationic sites are as follows:

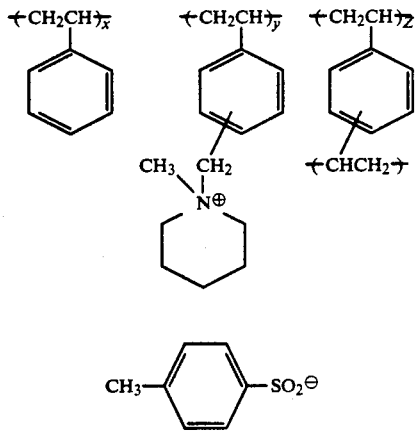

I)

x:y:Z = 47.5:47.5:5

-continued

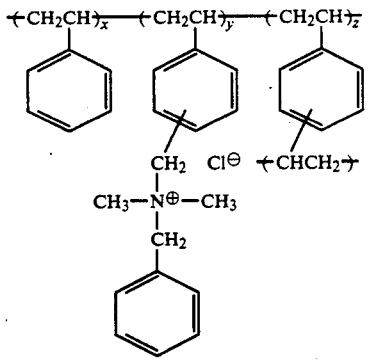

II)

x:y:z = 45:45:10

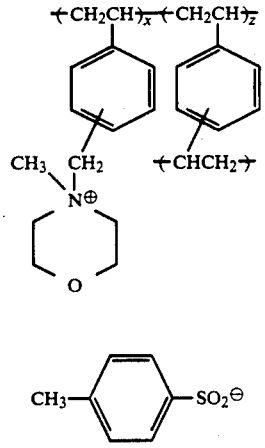

III)

x:z = 95:5

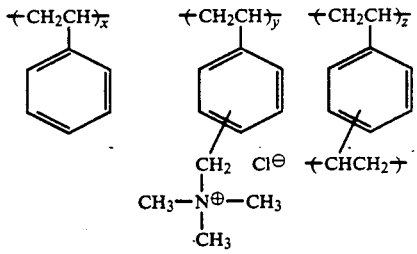

IV)

x:y:z = 45:45:10

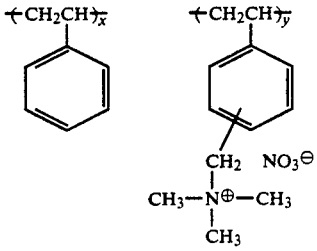

VI)

y:z = 90:10

-continued

V)

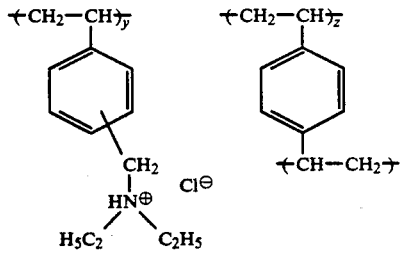

x:y = 50:50

VII)

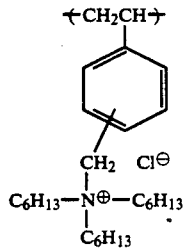

These polymers having cationic sites may be used alone or in combination. The molecular weight thereof is not critical, but it is desirably 1,000 to 1,000,000, preferably 5,000 to 200,000.

The amount of such polymers to be added to the light-sensitive material is not less than 0.1 cationic site units per mole of total iodine included in the light-sensitive material, preferably 0.3 to 100, more preferably 0.5 to 30.

The polymers having cationic sites may be added to either light-sensitive layers or non-light-sensitive layers, but it is preferred to add them in the non-light-sensitive layers disposed between the substrate and the light-sensitive layers or those disposed on the side of the substrate opposite to that having the light-sensitive layers. The polymers having high capacity of capturing iodide ions are desirably used in the invention.

As discussed above in detail, the color light-sensitive material of the present invention is characterized in that it has emulsion layers containing the aforementioned silver iodide and comprises polymer having cationic sites. The other constructions of the present invention will hereunder be explained in detail.

Processing of the Emulsion Layers and General Additives

The emulsions as used herein are physically ripened, chemically ripened or spectrally sensitized ones. Additives used in such processes are disclosed in Research Disclosure, Vol.176, No. 17643 (December, 1978) and ibid, Vol. 187, No. 18716 (November, 1979) and the relevant passages thereof are summarized in Table given below.

Known additives for photography usable in the present invention are also disclosed in these two articles and, therefore, the relevant passages thereof are also summarized in the following Table.

| Kind of Additive | RD17643 | RD18716 |
|---|---|---|
| 1 chemical sensitizing agent | p 23 | right column of p 648 |
| 2 sensitivity enhancing agent | | right column of p 648 |
| 3 spectral sensitizing agent | p 23–24 | right column of p 648 |
| 4 supersensitizing agent | | right column of p 649 |
| 5 whitening agent | p 24 | |
| 6 antifoggant and stabilizer | p 24–25 | right column of p 649 |
| 7 coupler | p 25 | |
| 8 organic solvent | p 25 | |
| 9 light absorber, filter dye | p 25–26 | right column of p 649 to left column of p 650 |
| 10 UV absorber | " | right column of p 649 to left column of p 650 |
| 11 stain resistant agent | right column of p 25 | p 650; left to right columns |
| 12 dye image stabilizer | p 25 | |
| 13 film hardening agent | p 26 | left column of p 651 |
| 14 binder | p 26 | left column of p 651 |
| 15 plasticizer, lubricant | p 27 | right column of p 650 |
| 16 coating aid, surfactant | p 26–27 | right column of p 650 |
| 17 antistatic agent | p 27 | right column of p 650 |

Couplers

The color light-sensitive materials of this invention may contain color couplers. The term "color coupler(s)" herein means compounds which react with an oxidized form of an aromatic primary amine developing agent to form dyes. Typical examples of useful color couplers are naphtholic or phenolic compounds, pyrazolone or pyrazoloazole type compounds and linear or heterocyclic ketomethylene coumpounds. Specific examples of these cyan-, magenta- and yellow-dye forming couplers usable in the present invention are disclosed in the patents cited in Research Disclosure No. 17643 (Dec., 1978), VII-D; and ibid, No. 18717 (Nov., 1979).

Color couplers included in the light-sensitive materials are preferably made non-diffusible by imparting thereto ballast groups or polymerizing them. In the present invention, 2-equivalent color couplers in which the active site for coupling is substituted with an elimination group is rather preferred than 4-equivalent color couplers in which the active site for coupling is hydrogen atom. This is because the amount of coated silver may, thereby, be reduced and the light-sensitive layer obtained has a high sensitivity. Futhermore, couplers in which a formed dye has a proper diffusibility, non-color couplers, DIR couplers which can release a development inhibitor through the coupling reaction or couplers which can release a development accelerator may also be used.

A typical yellow coupler usable in the present invention is an acylacetamide coupler of an oil protect type. Examples of such yellow couplers are disclosed in U.S. Pat. Nos. 2,407,210; 2,875,057 and 3,265,506. 2-Equivalent yellow couplers are preferably used in the present invention as already explained above. Typical examples thereof are the yellow couplers of an oxygen atom elimination type described in U.S. Pat. Nos. 3,408,194; 3,447,928, 3,933,501; and 4,022,620, or the yellow couplers of a nitrogen atom elimination type disclosed in J.P. KOKOKU No. 58-10739, U.S. Pat. Nos. 4,401,752; and 4,326,024; Research Disclosure No. 18053 (Apr., 1979); U.K. Patent No. 1,425,020; DEOS Nos. 2,129,917; 2,261,361; 2,329,587; and 2,433,812. Alphapivaloyl acetanilide type couplers are excellent in fastness, particularly light fastness, of formed dye. On the other hand, alpha-benzoyl acetanilide type couplers yield high color density.

Magenta couplers usable in the present invention include couplers of an oil protect type of indazolone, cyanoacetyl, or preferably pyrazoloazole type ones such as 5-pyrazolones and pyrazolotriazoles. Among 5-pyrazolone type couplers, couplers whose 3-position is substituted with an arylamino or acylamino groups are preferred from the viewpoint of color phase and color density of the formed dye. Typical examples thereof are disclosed in U.S. Pat. Nos. 2,311,082; 2,343,703; 2,600,788; 2,908,573; 3,062,653; 3,152,896; and 3,936,015. An elimination group of the 2-equivalent 5-pyrazolone type couplers is preferably a nitrogen atom elimination group described in U.S. Pat. No. 4,310,619 and an arylthio group described in U.S. Pat. No. 4,351,897. The 5-pyrazolone type coupler having ballast groups such as those described in European Patent No. 73,636 provides high color density.

As examples of pyrazoloazole type couplers, there may be mentioned such pyrazolobenzimidazoles as those disclosed in U.S. Pat. No. 3,369,879, preferably such pyrazolo(5,1-c) (1,2,4)triazoles as those disclosed in U.S. Pat. No. 3,725,067, such pyrazolotetrazoles as those disclosed in Research Disclosure No. 24220 (June, 1984) and such pyrazolopyrazoles as those disclosed in Research Disclosure No. 24230 (June, 1984). Imidazo(1,2-b)pyrazoles such as those disclosed in European Patent No. 119,741 are preferred on account of small yellow minor absorption of formed dye and light fastness. Pyrazolo(1,5-b)(1,2,4)triazoles such as those disclosed in European Patent No. 119,860 are particularly preferred.

Cyan couplers usable in the present invention include naththolic or phenolic couplers of an oil protect type. Typical examples of naththol type couplers are those disclosed in U.S. Pat. No. 2,747,293. Typical preferred 2-equivalent naphtholic couplers of oxygen atom elimination type are described in U.S. Pat. Nos. 4,052,212; 4,146,396; 4,228,233; and 4,296,200. Exemplary phenol type couplers are those described in U.S. Pat. Nos. 2,369,929; 2,801,171; 2,772,162; and 2,895,826.

Cyan couplers resistant to humidity and heat are preferably used in the present invention. Examples of such couplers are phenol type cyan couplers having an alkyl group higher than methyl group at a metha-position of a phenolic nucleus as described in U.S. Pat. No. 3,772,002; 2,5-diacylamino-substituted phenol type couplers as disclosed in U.S. Pat. Nos. 2,772,162; 3,758,308; 4,126,396; 4,334,011; and 4,327,173; DEOS No. 3,329,729; and Japanese Patent Application Serial No. 58-42671; and phenol type couplers having a phenylureido group at 2-position and an acylamino group at 5-position of the phenol nucleus as described in U.S. Pat. Nos. 3,446,622; 4,333,999; 4,451,559; and 4,427,767.

Graininess may be improved by using together a coupler which can form a dye having a moderate diffusibility. As such blur couplers, some magenta couplers are specifically described in U.S. Pat. No. 4,366,237 and U.K. Patent No. 2,125,570 and some yellow, magenta and cyan couplers are specifically described in European Patent No. 96,570 and DEOS No. 3,234,533.

Dye-forming couplers and the aforementioned special couplers may be a dimer or a higher polymer. Typical examples of such polymerized dye-forming couplers are described in U.S. Pat. Nos. 3,451,820 and 4,080,211. Examples of such polymerized magenta couplers are described in U.K. Patent No. 2,102,173 and U.S. Pat. No. 4,367,282.

Couplers as used herein may be added to a desired single light-sensitive layer, in combination, to impart the required properties to such light-sensitive material or a single coupler may be added to at least two different layers thereof.

The amount of the color couplers generally used is 0.001 to 1 mole per mole of light-sensitive silver halide, preferably 0.01 to 0.5 moles for yellow couplers; 0.003 to 0.3 moles for magenta couplers and 0.002 to 0.3 moles for cyan couplers.

The couplers as used herein may be introduced into the light-sensitive material by a variety of known methods for dispersion. Examples of high boiling point organic solvents used in oil-in-water dispersion method are disclosed in U.S. Pat. No. 2,322,027. Moreover, specific examples of processes, effects, latexes for impregnation in the latex dispersion method are disclosed in U.S. Pat. No. 4,193,363; and OLS Nos. 2,541,274 and 2,541,230.

Substrate

The photographic light-sensitive material is applied onto a substrate such a flexible substrate as plastic film (e.g. cellulose nitrate, cellulose acetate, and polyethylene terephthalate) and paper; and such a rigid substrate as glass plate. As to substrates and method for coating, reference is made to Research Disclosure Vol. 176, Item 17643 XV (p 27); XVII (p 28), Dec., 1978.

The color light-sensitive materials of the present invention may be in the form of, for instance, color negative films for general purpose or motion pictures; color reversal films for slide or television; and color reversal paper.

The method for processing the light-sensitive material of the present invention will now be explained hereinbelow.

Development

The color developer used in developing treatment of a light-sensitive material is preferably an alkaline aqueous solution containing aromatic primary amine type color developing agent as a principal component. Aminophenol type compounds are also useful as such a color developing agent, but preferred are p-phenylenediamine type compounds and typical examples thereof are 3-methyl-4-amino-N,N-diethylaniline, 3-methyl-4-amino-N-ethyl-N-beta-hydroxyethylaniline, 3-methyl-4-amino-N-ethyl-N-beta-methanesulfonamide ethylaniline, 3-methyl-4-amino-N-ethyl-N-beta-methoxyethylaniline; and sulfates, hydrochlorides or p-toluenesulfonates thereof. These diamines in the form of salts are generally more stable than those in the form of free state and are preferably used.

The color developer generally contains a pH buffering agent such as carbonates, borates or phosphates of alkali metals; a development inhibitor such as bromides, iodides, benzimidazoles, benzothiazoles or mercapto coumpounds; an antifoggant or the like. Moreover, it is also possible to optionally add, to such color developers, a variety of preservatives such as hydroxylamine, diethylhydroxylamine, sulfites and those disclosed in Japanese Patent Application Serial No. 61-280792; an organic solvent such as triethanolamine and diethylene glycol; a development accelerator such as benzyl alcohol, polyethylene glycol, quaternary ammonium salts and amines; a fogging agent such as dye-forming couplers, competing couplers and sodium borohydride; an auxiliary agent for developing such as 1-phenyl-3-pyrazolidone; a thickener; a variety of chelating agents such as aminopolycarboxylic acids, aminopolyphosphonic acids, alkylphosphonic acids and phosphonocarboxylic acids; and an antioxidant such as those disclosed in OLS No. 2,622,950; and the like.

If the reversal treatment is carried out, the light-sensitive materials are commonly subjected to monochromatic development before the color development. In the monochromatic developer, known monochromatic developing agents such dihydroxybenzenes as hydroquinone; such 3-pyrazolidones as 1-phenyl-3-pyrazolidone; or such aminophenols as N-methyl-p-aminophenol may be used alone or in combination.

The amount of these color developer and monochromatic developer to be replenished may vary depending on color photographic light-sensitive materials processed and are generally not more than 3 liter per unit area (1 $m_2$)) of the material. In this connection, the amount to be replenished may be reduced to not more than 500 ml if the amount of bromide ions in the replenishers is reduced to a desired concentrations, for instance, utilizing a means for restricting the accumulation of bromide ions therein. For the purpose of reducing the amount of the replenishers, it is preferred to reduce the area of the opening of the processing baths to thereby prevent the evaporation or air-oxidation of the processing solutions.

Bleaching, Fixing

After color development, the photographic emulsion layer is usually bleached. This bleaching treatment may be carried out together with fixing treatment simultaneously or separately. Moreover, a processing method in which the bleaching treatment is followed by bleaching-fixing treatment may also be employed in order to attain a quick processing. In accordance with purposes, fixing treatment may be carried out before the bleaching-fixing treatment or bleaching treatment may be carried out after the bleaching-fixing treatment.

As bleaching agents, there may be used polyvalent metal coumpounds such as iron(III), cobalt(III), chromium(IV) or copper(II) compounds; peracids; quinones or nitroso compounds. Typical examples of such bleaching agent include ferricyanides, bichromates, organix complexs or iron(III) or cobalt(III), for instance, complex salts of aminopolycarboxylic acids such as ethylenediaminetetraacetic acid, diethylenetriaminepentaacetic acid, cyclohexanediaminetetraacetic acid, methyliminodiacetic acid, 1,3-diaminopropanetetraacetic acid and glycol ether diaminetetraacetic acid, or complex salts of organic acids such as citric acid, tartaric acid and malic acid; persulfates, bromates, manganates; or nitrosophenol. Among these, iron(III) (ferric) aminopolycarboxylates such as iron(III) ethylenediaminetetraacetate and persulfates are preferred from the viewpoint of quick processing and environmental protection. Moreover, iron(III) aminopolycarboxylates are particularly useful not only in independent bleaching solution but also in an one-bath bleaching-fixing solution.

A bleaching accelerator may optionally be used in the bleaching, bleaching-fixing solutions and preceding baths thereof. Specific examples of useful bleaching accelerators include compounds having mercapto or disulfide groups; thiazolidine derivatives; thiourea derivatives; iodides; polyethylene oxides; polyamine compounds; iodide or bromide ions. Inter alia, the compounds having mercapto or disulfide groups are preferred because of their high acceleration effect and particularly preferred examples thereof are those disclosed in U.S. Pat. No. 3,893,858; German Patent No. 1,290,812 and J.P. KOKAI No. 53-95630. In addition, compounds disclosed in U.S. Pat. No. 4,552,834 are also preferable. These bleaching accelerators may be added to light-sensitive materials. These bleaching accelerators are effective in particular when bleaching and fixing color light-sensitive materials for taking photographs.

Examples of fixing agents are thiosulfates, thiocyanates, thioether type compounds, thioureas or excess of iodides, however, thiosulfates are generally used and particularly ammonium thiosulfate can most widely be used. Preferred preservatives for bleaching-fixing or fixing sulution include sulfites, bisulfites and carbonyl bisulfite adducts.

The processing solution having fixing ability among the foregoing processing solutions for desilvering process is preferably replenished in an amount of not less than 300 ml per 1 $m^2$ of the processed light-sensitive material, particularly 300 ml to 1,000 ml. Moreover, when the material is processed with bleaching solution, the amount thereof replenished is preferably not less than 50 ml/$m^2$, in particular 100 to 500 ml.

Water Washing, Stabilization

After desilvering, the silver halide color photographic light-sensitive material is in general subjected to water washing process and/or stabilization process.

The amount of washing water in the water washing process may widely vary dependent upon properties of the material (which are determined by materials used, for instance, couplers), applications, number of water washing baths (step number), manners for replenishing such as countercurrent flow or direct flow system and other various conditions. In this connection, the relation between the number of water washing tanks and the amount of water in the multistage countercurrent flow system can be determined by the method disclosed in Journal of the Society of Motion Picture and Television Engineers, Vol. 64, p 248–253 (May, 1955).

In accordance with the multistage countercurrent flow system disclosed in the foregoing article, the amount of washing water can be substantially reduced, while the residence time of water in the tanks increases. Therefore, bacteria proliferate therein to thereby cause the formation of floating materials which adhere to the processed light-sensitive materials. The inventors of this invention already developed a solution for such a problem (see U.S. Ser. No. 057254 filed on Jun. 3, 1987), which can also be applied effectively to the processing of the color light-sensitive material of this invention. The method comprises reducing the amount of calcium and magnesium compounds in processing solutions to a desired level. Alternatively, it is also possible to use an antibacterial agent such as chlorine type antibacterial agent, for instance, isothiazolone compounds or thiabendazoles as disclosed in J.P. KOKAI No. 57,8542 or sodium chlorinated isocyanurate; or other antibacterial agents such as benzotriazole disclosed in "BOKIN BOBAIZAI NO KAGAKU (Chemistry of antibacterial and antifungus agents)", Hiroshi HORIGUCHI; "BISEIBUTUSU NO MEKKIN, SAKKIN AND BOBAI GIJUTSU (Sterilization, Pasteurization and Mold Controlling Techniques)", edited by Sanitary Engineering Society; and "Dictionary of Antibacterial and antifungus agents", edited by Japan Bacteria and Fungi Controlling Society.

The washing water used in the processing of the light-sensitive materials of this invention has pH of 4 to 9, preferably 5 to 8. The temperature and time for water washing may vary dependent upon various factors such as properties and applications of the processed light-sensitive materials, but the materials are generally processed at 15° to 45° C. for 20 seconds to 10 minutes, preferably at 25° to 40° C. for 30 seconds to 5 minutes.

Moreover, the light-sensitive materials of this invention may be directly treated with a stabilization solution without water washing. In such a stabilization treatment, all the methods disclosed in J.P. KOKAI Nos. 57-8543, 58-14834 and 60-220345 and the like may be applied.

Alternatively, the stabilization treatment may be carried out subsequent to the water washing process. Examples thereof is a treatment with a bath containing formalin and surfactants and used as the final bath for treating color light-sensitive materials for taking photographs. Such a stabilization bath may contain a variety of chelating agents and antifungus agents.

Overflow accompanied by the replenishment of washing water and/or stabilization solutions may be recycled to other processes such as desilvering process.

The silver halide color photographic light-sensitive materials may include color developing agent for the purposes of simplifying and promoting the processing. In order to incorporate such color developing agent therein, various precursors thereof are preferably employed. Examples of such precursors are indoaniline type compounds as disclosed in U.S. Pat. No. 3,342,597; schiff base type compounds as disclosed in U.S. Pat. No. 3,342,599, Research Disclosure Nos. 14,850 and 15,159; aldol compounds as disclosed in Research Disclosure No. 13,924; metal complexes as disclosed in U.S. Pat. No. 3,719,492 and urethane type compounds as dislcosed in J.P. KOKAI No. 53-135628.

The silver halide color light-sensitive materials of the present invention may optionally include a variety of 1-phenyl-3-pyrazolidones to promote color development. Typical examples of such compounds are those disclosed in J.P. KOKAI Nos. 56-64339, 57-144547 and 58-115438.

The temperature of various processing solutions used in the present invention are 10° to 50° C. The standard temperature thereof is 33° to 38° C. However, in order to promote the processing, more higher temperature may be used while a lower temperature may also be used to enhancing the quality of images and to improve the stability of the processing solutions. In addition, it is also possible to carry out the processing in which cobalt or hydrogen peroxide intensification as disclosed in German Patent No. 2,226,770 and U.S. Pat. No. 3,674,499 is utilized to save silver.

The processing baths may be optionally equipped with devices such as heaters, temperature sensors, level sensors, circulation pumps, filters, floating covers or squeezers.

In continuous processings, changes in the composition of processing solutions can be prevented by using each corresponding replenisher so as to attain a uniform finishing of the processed materials. The amount of the replenishers may be reduced to at most ½ times the standard replenishing amount thereof for cost-saving.

As discussed above in detail, the silver halide color light-sensitive materials of the present invention comprise at least one silver halide emulsion layer containing a specific amount of silver iodide and polymer having cationic sites. Therefore, the light-sensitive materials of this invention exhibit good graininess, high sensitivity and excellent desilvering properties.

The silver halide color photographic light-sensitive materials according to the present invention will hereunder be explained in more detail with reference to the following non-limitative working examples and the effects practically achieved will also be discussed in comparison with comparative examples.

EXAMPLE 1

A color light-sensitive material (Sample No. 101) was prepared by applying, in order, layers having the following compositions onto a substrate of cellulose triacetate.

| | |
|---|---|
| 1st Layer: Red-sensitive Emulsion Layer | |
| Silver iodobromide emulsion (AgI content = 3 mole %; a type wherein AgI content is high inside thereof; diameter corresponding to sphere = 1.0 micron, coefficient of variation thereof (C.V.) = 20%; grain; diameter/thickness ratio = 3) | 2.5 g/m$^2$ (Ag) |
| Gelatin | 3.3 g/m$^2$ |
| Sensitizing dye I | $3 \times 10^{-4}$ moles (per mole of Ag) |
| Sensitizing dye II | $1 \times 10^{-4}$ moles (per mole of Ag) |
| Coupler Ex-1 | 1.4 g/m$^2$ |
| Solvent 1 | 0.5 g/m$^2$ |
| Solvent 2 | 0.5 g/m$^2$ |
| 2nd Layer: First protective Layer | |
| Gelatin | 1.8 g/m$^2$ |
| Cationic polymer (as to kinds and amount, see Table I) | |
| Ultraviolet absorber UV-1 | 0.1 g/m$^2$ |
| Ultraviolet absorber UV-2 | 0.2 g/m$^2$ |
| Solvent 1 | 0.01 g/m$^2$ |
| Solvent 2 | 0.01 g/m$^2$ |
| 3rd Layer: Second Protective Layer | |
| Gelatin | 1.5 g/m$^2$ |
| Polymethyl methacrylate particles (diameter = 1.5 microns) | 0.2 g/m$^2$ |

To each layer, there were added gelatin hardening agent H-1 and surfactants in addition to the foregoing components.

The compounds used are as follows:

Sensitizing Dye I

-continued

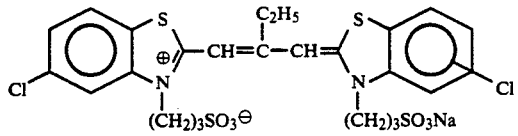

Sensitizing Dye II

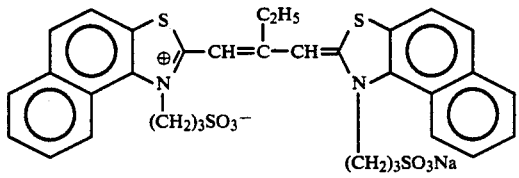

Color Coupler Ex-1

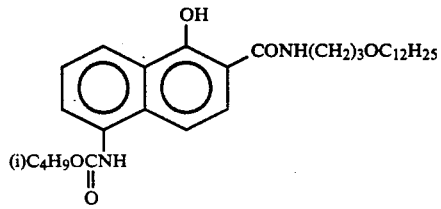

Solvent-1

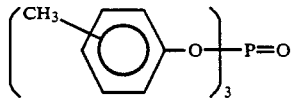

Solvent-2

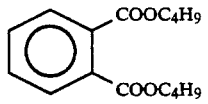

H-1

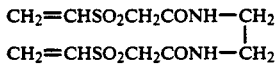

The silver iodobromide emulsion used to form Sample 101 was prepared as follows:

To a reaction vessel containing an aqueous gelatin solution to which potassium iodide and potassium bromide were previously added, and which was maintained at 60° C., there were added an ammoniacal silver nitride and an aqueous solution of alkali halide over 40 minutes while maintaining pAg at 8.7, washed with water to remove salts and then gelatin was added to obtain an emulsion having pAg of 8.0 and pH of 6.2. Further, there were added to the emulsion sodium thiosulfate, chloroauric acid and potassium rhodanide, the emulsion was chemically aged at 58° C. for 60 minutes and 4-hydroxy-6-methyl-1,3,3a,7-tetrazaindene was added thereto to form the intended silver iodobromide emulsion for Sample 101.

Then, emulsions were prepared by changing the composition of alkali halide in the foregoing emulsion so as to change the silver iodide content (mole %) thereof and Samples 102 to 129 having the layer structures listed in Table I were prepared by using these emulsions.

Samples thus produced were exposed to light so that the amount of developed silver formed during color developing process was equal to $2\pm0.05$ g/m$^2$ and then were developed according to the following processes. The amount of remaining silver of the processed light-sensitive material was analyzed by fluorescent X-ray method and the results were listed in Table I together with graininess and sensitivity.

In Table I, the amount of the cationic polymer is expressed as the amount of cationic sites per mole of total iodine included in the light-sensitive material (these in the following Tables are also shown in the same way).

| Process | Time (sec.) | Temp. (°C.) |
|---|---|---|
| Color development | 150 | 38 |
| Bleaching-fixing | 60 | 38 |
| Water washing (1) | 30 | 38 |
| Water washing (2) | 30 | 38 |
| Stabilization | 30 | 38 |

In this respect, the replenishment in the water washing processes (1) and (2) was carried out by countercurrent system from tank 1 to tank 2. The compositions of the processing solutions were as follows:

| Component | Amount (g) |
|---|---|
| Color Developing Solution: Tank Solution | |
| Diethylenetriaminepentaacetic acid | 2.0 |
| 1-Hydroxyethylidene-1,1-diphosphonic acid | 3.0 |
| Sodium sulfite | 4.0 |
| Potassium carbonate | 30.0 |
| Potassium bromide | 1.4 |
| Potassium iodide | 1.5 (mg) |
| Hydroxylamine sulfate | 2.4 |
| 4-(N-ethyl-N-(beta-hydroxyethyl)-amino)-2-methylaniline sulfate | 4.5 |
| Water | to 1 liter |
| pH | 10.5 |
| Bleaching-fixing Solution: Tank Solution | |
| Ferric ammonium ethylenediaminetetraacetate dihydrate | 50.0 |
| Disodium ethylenediaminetetraacetate | 5.0 |
| Sodium sulfite | 12.0 |
| 70% Aqueous ammonium thiosulfate solution | 260.0 (ml) |
| 98% Acetic acid | 5.0 (ml) |
| Bleaching accelerator | 0.01 (mole) |

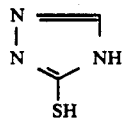

| | |
|---|---|
| Water | to 1 liter |
| pH | 6.0 |

Washing Water 1 or 2

These were prepared by passing tap water through a mixed bed type column packed with an H-type strong acidic cation exchange resin (available from MITSUBISHI CHEMICAL INDUSTRIES LTD. under the trade name of Diaion SK-1B) and an OH-type strong basic anion exchange resin (available from the same company under the trade name of Diaion SA-10A) to obtain water having the following properties and then adding 20 mg/l of sodium dichloroisocyanurate as an antibacterial agent:

| | |
|---|---|
| Calcium ions | 1.1 mg/l |
| Magnesium ions | 0.5 mg/l |
| pH | 6.9 |

| Stabilization Solution: Tank Solution Component | Amount (g) |
|---|---|
| 37% Formalin | 2.0 (ml) |
| Polyoxyethylene-p-monononyl phenyl ether (average degree of polymerization = 10) | 0.3 |
| Disodium ethylenediaminetetraacetate | 0.05 |
| Water | to 1 liter |
| pH | 5.0 to 8.0 |

As is obvious from Table I, the amount of remaining silver increases as the iodine content in the emulsion increases. This tendency becomes remarkable when the iodine content exceeds 7 mole %. The amount of remaining silver is extremely reduced if the polymer having cationic sites is used simultaneously. Therefore, it is clear that the material of the invention shows excellent effects.

A light-sensitive material was also prepared by replacing silver iodide in Sample 102 with silver chlorobromide and was developed by the same manner. The remaining silver of this Sample was 3.5 micrograms; the graininess thereof 5.0; and the sensitivity 0.15. Even when compared with these results, the light-sensitive material of the present invention exhibited excellent graininess and sensitivity.

In Table I, the graininess is expressed as RMS degree of graininess at density of 1.0 and the relative sensitivity is expressed as the relative value determined by obtaining, as the sensitivity, the logarithm of the reciprocal of the amount of exposed light which resulted in the density of 1.0 while defining the sensitivity of Sample 103 to 1.0, and summing the sensitivity of Sample 103 and the difference between the sensitivities of Samples 103 and others.

TABLE 1

| Sample No. | Iodine content in 1st Layer (mole %) | Cationic Polymer content in 2nd Layer | Amount of Cationic Polymer |
|---|---|---|---|
| 101(*) | 3.0 | — | — |
| 102(*) | 5.0 | — | — |
| 103(*) | 7.0 | — | — |
| 104 | 7.0 | illustrated Compound I | 0.05 |
| 105 | 7.0 | " | 0.1 |
| 106 | 7.0 | " | 0.5 |
| 107 | 7.0 | " | 5.0 |
| 108 | 7.0 | " | 10.0 |
| 109 | 7.0 | illustrated Compound III | 0.05 |
| 110 | 7.0 | " | 0.1 |
| 111 | 7.0 | " | 0.5 |
| 112 | 7.0 | " | 5.0 |
| 113 | 7.0 | " | 10.0 |
| 114(*) | 10.0 | — | — |
| 115 | 10.0 | illustrated Compound I | 0.05 |
| 116 | 10.0 | " | 0.1 |
| 117 | 10.0 | " | 0.5 |
| 118 | 10.0 | " | 5.0 |
| 119 | 10.0 | " | 10.0 |
| 120 | 10.0 | illustrated Compound III | 0.05 |
| 121 | 10.0 | " | 0.1 |
| 122 | 10.0 | " | 0.5 |
| 123 | 10.0 | " | 5.0 |
| 124 | 10.0 | " | 10.0 |
| 125 | 10.0 | illustrated Compound V | 0.05 |
| 126 | 10.0 | " | 0.1 |
| 127 | 10.0 | " | 0.5 |
| 128 | 10.0 | " | 5.0 |
| 129 | 10.0 | " | 10.0 |

| Sample No. | Amount of remaining Ag ($\mu g/cm^2$) | Graininess | Relative sensitivity |
|---|---|---|---|
| 101(*) | 8.0 | 4.5 | 0.53 |
| 102(*) | 8.5 | 4.0 | 0.69 |
| 103(*) | 12.0 | 3.6 | 1.00 |
| 104 | 6.4 | 3.5 | 1.01 |
| 105 | 5.3 | 3.6 | 1.00 |
| 106 | 4.2 | 3.5 | 1.03 |
| 107 | 1.8 | 3.5 | 1.10 |
| 108 | 2.5 | 3.6 | 1.15 |
| 109 | 6.7 | 3.6 | 1.00 |
| 110 | 6.0 | 3.5 | 1.01 |
| 111 | 4.8 | 3.6 | 1.02 |
| 112 | 2.4 | 3.6 | 1.08 |
| 113 | 3.0 | 3.7 | 1.14 |
| 114(*) | 15.0 | 3.0 | 1.25 |
| 115 | 6.5 | 3.1 | 1.25 |
| 116 | 5.1 | 3.0 | 1.26 |
| 117 | 4.4 | 3.0 | 1.29 |
| 118 | 1.5 | 2.9 | 1.36 |
| 119 | 1.9 | 3.0 | 1.45 |
| 120 | 6.2 | 3.1 | 1.26 |
| 121 | 4.9 | 3.1 | 1.26 |
| 122 | 3.6 | 3.0 | 1.28 |
| 123 | 1.4 | 3.0 | 1.37 |
| 124 | 1.8 | 3.0 | 1.48 |
| 125 | 6.1 | 3.1 | 1.26 |
| 126 | 4.8 | 3.1 | 1.28 |
| 127 | 3.5 | 3.0 | 1.31 |
| 128 | 1.3 | 2.9 | 1.41 |

TABLE 1-continued

| | | | |
|---|---|---|---|
| 129 | 2.0 | 2.9 | 1.50 |

(*): Comparative Examples

EXAMPLE 2

A multilayered color light-sensitive material (Sample 201) was prepared by applying, in order, the following layers having the compositions defined below onto a substrate of cellulose triacetate film having an underlying layer.

Composition of the Light-sensitive Layer

In the following composition, the coated amount of silver halide and colloidal silver is expressed as a reduced amount of elemental silver (g/m$^2$), that of coupler, additives and gelatin is expressed as g/m$^2$ and that of sensitizing dye is expressed as molar amount per unit mole of silver halide included in the same layer.

| | |
|---|---|
| 1st Layer: Antihalation Layer | |
| Black colloidal silver | 0.2 |
| Gelatin | 1.3 |
| Coupler ExM-9 | 0.06 |
| Ultraviolet absorber UV-1 | 0.03 |
| Ultraviolet absorber UV-2 | 0.06 |
| Ultraviolet absorber UV-3 | 0.06 |
| Dispersion oil Solv-1 | 0.15 |
| Dispersion oil Solv-2 | 0.15 |
| Dispersion oil Solv-3 | 0.05 |
| 2nd Layer: Intermediate Layer | |
| Gelatin | 1.0 |
| Ultraviolet absorber UV-1 | 0.03 |
| Coupler ExC-4 | 0.02 |
| Compound ExF-1 | 0.004 |
| Dispersion oil Solv-1 | 0.1 |
| Dispersion oil Solv-2 | 0.1 |
| 3rd Layer: Low Sensitive Red-sensitive Emulsion Layer | |
| Silver iodobromide emulsion (AgI content = 4 mole %; a type wherein AgI is uniformly distributed; diameter corresponding to sphere = 0.5 microns, C.V. = 20%; plate-like grain; diameter/thickness = 3.0) | 1.2 (Ag) |
| Silver iodobromide emulsion (AgI content = 3 mole %; a type wherein AgI is uniformly distributed; diameter corresponding to sphere = 0.3 microns, C.V. = 15%; plate-like grain; diameter/thickness = 1.0) | 0.6 (Ag) |
| Gelatin | 1.0 |
| Sensitizing dye ExS-1 | $4 \times 10^{-4}$ |
| Sensitizing dye ExS-2 | $5 \times 10^{-5}$ |
| Coupler ExC-1 | 0.05 |
| Coupler ExC-2 | 0.50 |
| Coupler ExC-3 | 0.03 |
| Coupler ExC-4 | 0.12 |
| Coupler ExC-5 | 0.01 |
| 4th Layer: High Sensitive Red-sensitive Emulsion Layer | |
| Silver iodobromide emulsion (AgI content = 4 mole %; a type wherein AgI content is high inside thereof (core/shell ratio = 1:1); diameter corresponding to sphere = 0.7 microns, C.V. thereof = 15%; plate-like grain; diameter/thickness = 5.0) | 0.7 (Ag) |
| Gelatin | 1.0 |
| Sensitizing dye ExS-1 | $3 \times 10^{-4}$ |
| Sensitizing dye ExS-2 | $2.3 \times 10^{-5}$ |
| Coupler ExC-6 | 0.11 |
| Coupler ExC-7 | 0.05 |
| Coupler ExC-4 | 0.05 |
| Dispersion oil Solv-1 | 0.05 |
| Dispersion oil Solv-3 | 0.05 |
| 5th Layer: Intermediate Layer | |
| Gelatin | 0.5 |
| Compound Cpd-1 | 0.1 |
| Dispersion oil Solv-1 | 0.05 |
| 6th Layer: Low Sensitive Green-sensitive Emulsion Layer | |
| Silver iodobromide emulsion (AgI content = 4 mole %; a type wherein AgI content is high at surface region thereof and the core/shell ratio = 1:1; diameter corresponding to sphere = 0.5 microns, C.V. = 15%; plate-like grain; diameter/thickness = 4.0) | 0.35 (Ag) |
| Silver iodobromide emulsion (AgI content = 3 mole %; a type wherein AgI is uniformly distributed; diameter corresponding to sphere = 0.3 microns, C.V. = 25%; spherical grain; diameter/thickness = 1.0) | 0.20 (Ag) |
| Gelatin | 1.0 |
| Sensitizing dye ExS-3 | $5 \times 10^{-4}$ |
| Sensitizing dye ExS-4 | $3 \times 10^{-4}$ |
| Sensitizing dye ExS-5 | $1 \times 10^{-4}$ |
| Coupler ExM-8 | 0.4 |
| Coupler ExM-9 | 0.07 |
| Coupler ExM-10 | 0.02 |
| Coupler ExY-11 | 0.03 |
| Dispersion oil Solv-1 | 0.3 |
| Dispersion oil Solv-4 | 0.05 |
| 7th Layer: High Sensitive Green-sensitive Emulsion Layer | |
| Silver iodobromide emulsion (AgI content = 4 mole %; a type wherein AgI content is high inside thereof (core/shell ratio = 1:1); diameter corresponding to sphere = 0.7 microns, C.V. thereof = 20%; plate-like grain; diameter/thickness = 5.0) | 0.8 (Ag) |
| Gelatin | 1.0 |
| Sensitizing dye ExS-3 | $5 \times 10^{-4}$ |
| Sensitizing dye ExS-4 | $3 \times 10^{-4}$ |
| Sensitizing dye ExS-5 | $1 \times 10^{-4}$ |
| Coupler ExM-8 | 0.1 |
| Coupler ExM-9 | 0.02 |
| Coupler ExY-11 | 0.03 |
| Coupler ExC-2 | 0.03 |
| Coupler ExM-14 | 0.01 |
| Dispersion oil Solv-1 | 0.2 |
| Dispersion oil Solv-4 | 0.01 |
| 8th Layer: Intermediate Layer | |
| Gelatin | 0.5 |
| Compound Cpd-1 | 0.5 |
| Dispersion oil Solv-1 | 0.2 |
| 9th Layer: Donor Layer Imparting Interlayer Effect to the Red-sensitive Layer | |
| Silver iodobromide emulsion (AgI content = 2 mole %; a type wherein AgI content is high inside thereof (core/shell ratio = 2:1); diameter corresponding to sphere = 1.0 micron, C.V. thereof = 15%; plate-like grain; diameter/thickness = 6.0) | 0.35 (Ag) |
| Silver iodobromide emulsion (AgI content = 2 mole %; a type wherein AgI content is high inside thereof (core/shell ratio = 1:1); diameter corresponding to sphere = 0.4 microns, C.V. thereof = 20%; plate-like grain; diameter/thickness = 6.0) | 0.20 (Ag) |
| Gelatin | 0.5 |
| Sensitizing dye ExS-3 | $8 \times 10^{-4}$ |
| Coupler ExY-13 | 0.11 |
| Coupler ExM-12 | 0.03 |
| Coupler ExM-14 | 0.10 |
| Dispersion oil Solv-1 | 0.20 |
| 10th Layer: Yellow Filter Layer | |
| Yellow colloidal silver | 0.05 |
| Gelatin | 0.5 |
| Compound Cpd-2 | 0.13 |
| Compound Cpd-1 | 0.10 |
| 11th Layer: Low Sensitive Blue-sensitive Emulsion Layer | |
| Silver iodobromide emulsion (AgI content = 4.5 mole %; a type wherein AgI is uniformly distributed; diameter corresponding to sphere = 0.7 microns, C.V. thereof = 15%; plate-like grain; diameter/thickness = 7.0) | 0.3 (Ag) |
| Silver iodobromide emulsion (AgI content = 3 mole %; a type wherein AgI is uniformly | 0.15 (Ag) |

-continued

| | |
|---|---|
| distributed; diameter corresponding to sphere = 0.3 microns, C.V. = 25%; plate-like grain; diameter/thickness = 7.0) | |
| Gelatin | 1.6 |
| Sensitizing dye ExS-6 | $2 \times 10^{-4}$ |
| Coupler ExC-16 | 0.05 |
| Coupler ExC-2 | 0.10 |
| Coupler ExC-3 | 0.02 |
| Coupler ExY-13 | 0.07 |
| Coupler ExY-15 | 0.5 |
| Coupler ExC-17 | 1.0 |
| Dispersion oil Solv-1 | 0.20 |
| 12th Layer: High Sensitive Blue-sensitive Emulsion Layer | |
| Silver iodobromide emulsion (AgI content = 4 mole %; a type wherein AgI is uniformly distributed; diameter corresponding to sphere = 1.0 micron, C.V. = 25%; multiple twined tabular grain; diameter/thickness = 2.0) | 0.5 (Ag) |
| Gelatin | 0.5 |
| Sensitizing dye ExS-6 | $1 \times 10^{-4}$ |
| Coupler ExY-15 | 0.20 |
| Coupler ExY-13 | 0.01 |
| Dispersion oil Solv-1 | 0.10 |
| 13th Layer: First Protective Layer | |

-continued

| | |
|---|---|
| Gelatin | 0.8 |
| Ultraviolet absorber UV-4 | 0.1 |
| Ultraviolet absorber UV-5 | 0.15 |
| Disperison oil Solv-1 | 0.01 |
| Dispersion oil Solv-2 | 0.01 |
| 14th Layer | |
| Fine grain silver bromide emulsion (AgI content = 2 mole %; a type wherein AgI is uniformly distributed; diameter corresponding to sphere = 0.07 microns) | 0.5 |
| Gelatin | 0.45 |
| Polymethyl methacrylate particles (diameter = 1.5 microns) | 0.2 |
| Film hardening agent H-1 | 0.4 |
| Compound Cpd-3 | 0.5 |
| Compound Cpd-4 | 0.5 |

In addition to the foregoing components, a stabilizer Cpd-3 for emulsion (0.041 g/m$^2$) and a surfactant Cpd-4 (0.02 g/m$^2$) as a coating aid were added to each layer. Further, the following compounds Cpd-5 (0.5 g/m$^2$) and Cpd-6 (0.5 g/m$^2$) were also added. Details of the compounds used to obtain each layer are as follows.

UV-1

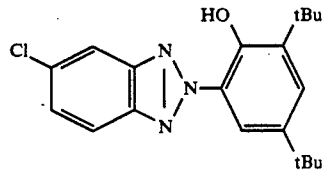

UV-2

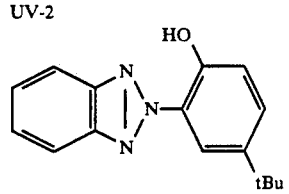

UV-3

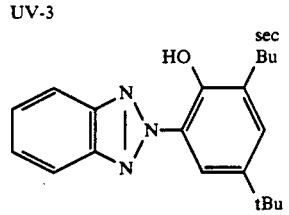

UV-4

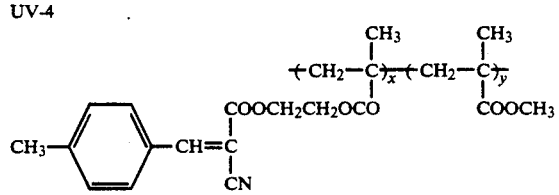

(x/y = 7/3: weight ratio)

UV-5

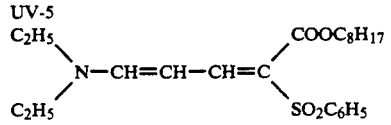

Solv-1: Tricresyl Phosphate

Solv-2: Dibutyl Phthalate

Solv-3

-continued
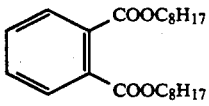
Solv-4
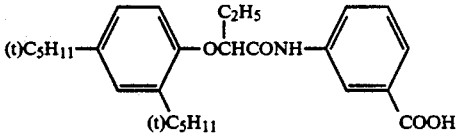
Cpd-1
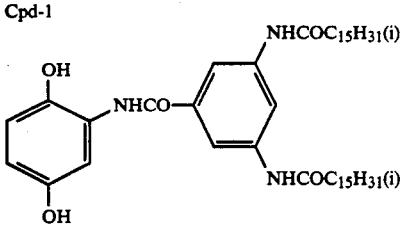
Cpd-2
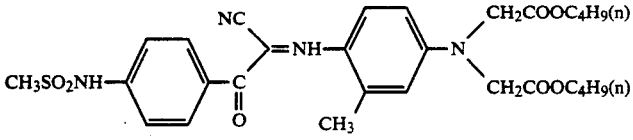
Cpd-3
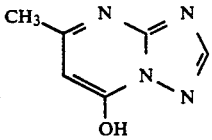
Cpd-4
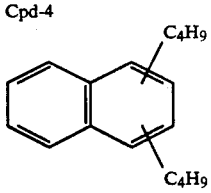
Cpd-5
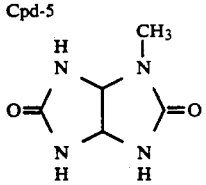
Cpd-6
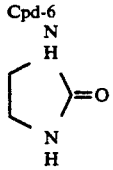
ExC-1
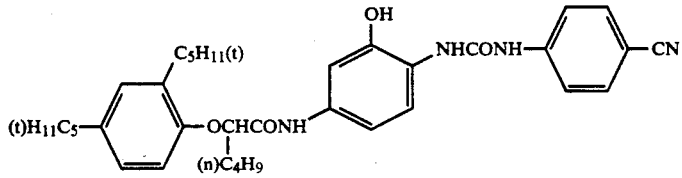

-continued
ExC-2
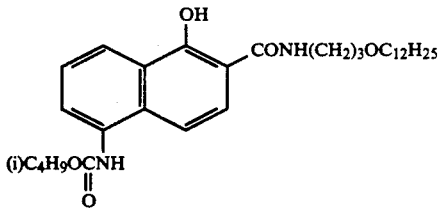
ExC-3
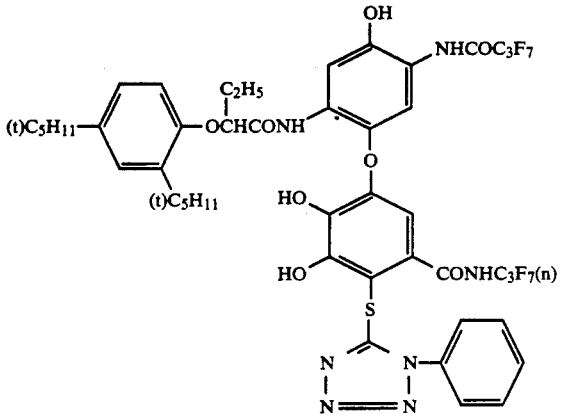
ExC-4
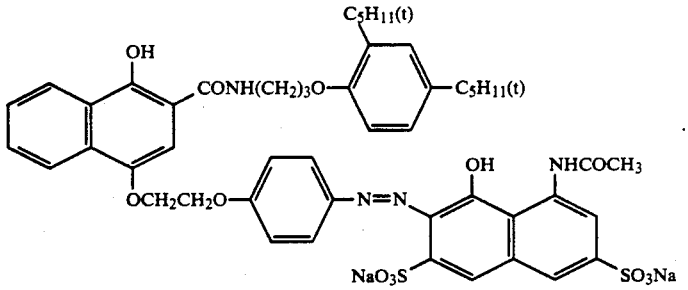
ExC-5
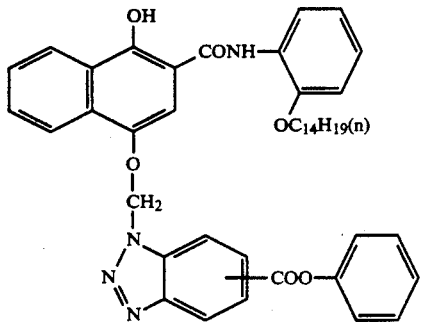
ExC-6

-continued
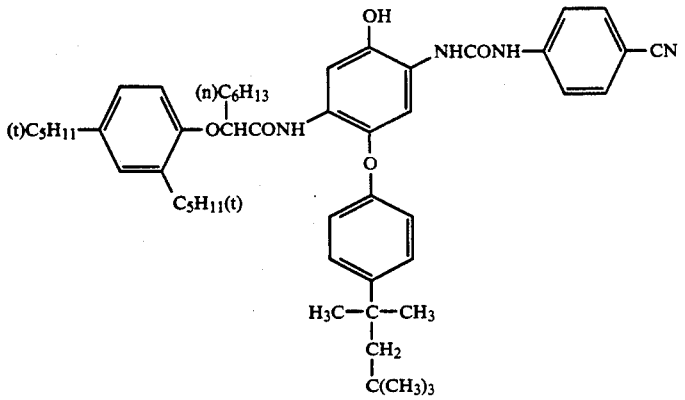
ExC-7
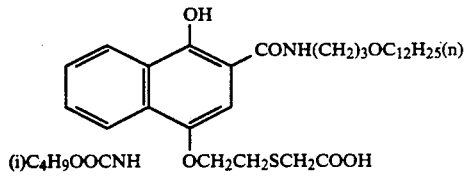
ExM-8
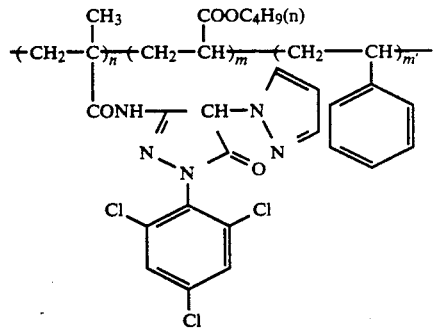
n = 50
m = 25
m' = 25
Molecular weight = about 20,000
ExM-9
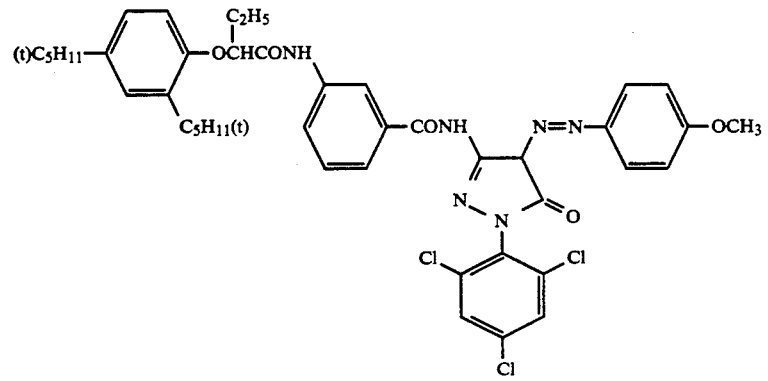
ExM-10

-continued
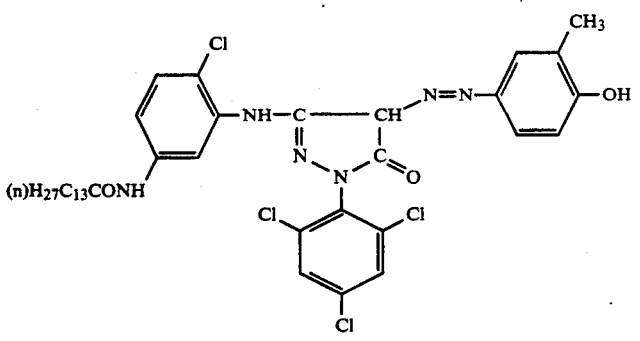
ExY-11
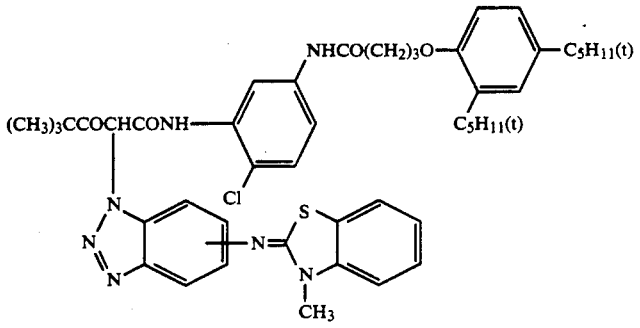
ExM-12
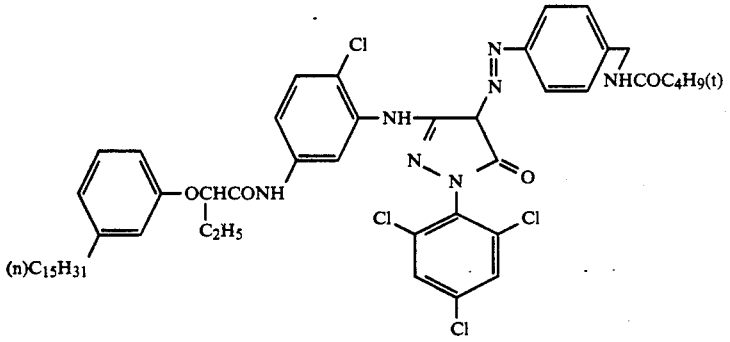
ExY-13
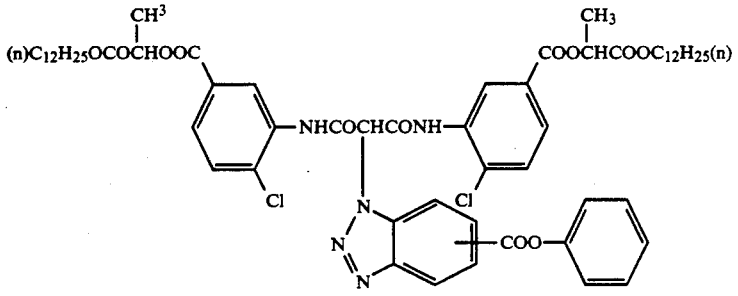
ExM-14

-continued
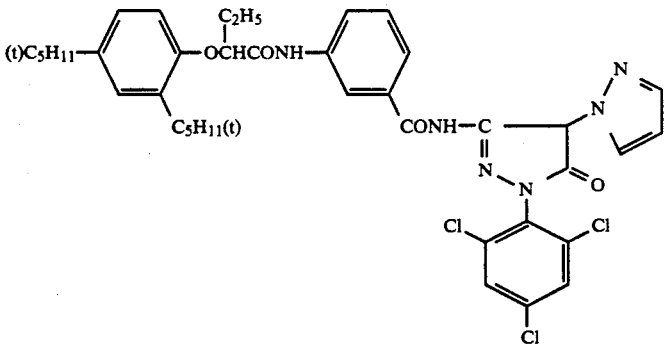
ExY-15
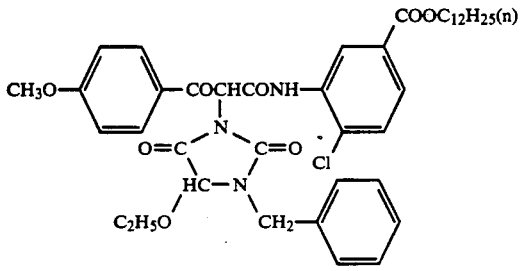
ExC-16
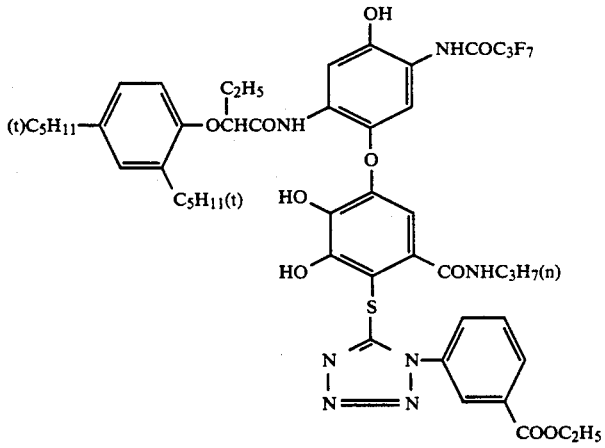
ExY-17
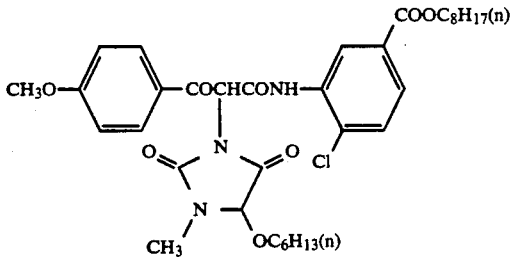
ExS-1
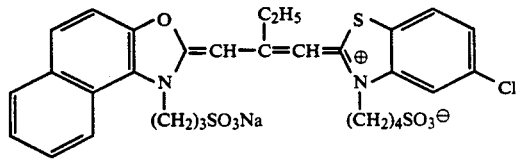
ExS-2

-continued

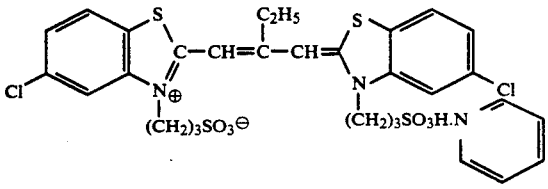

ExS-3

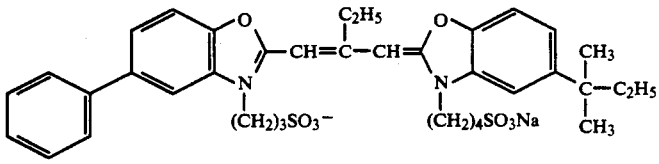

ExS-4

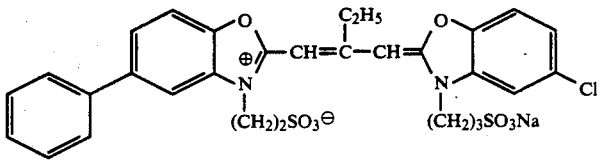

ExS-5

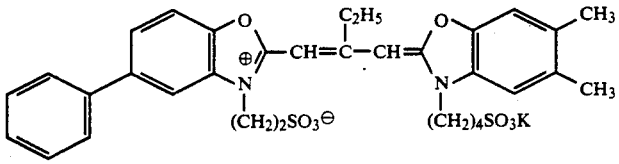

ExS-6

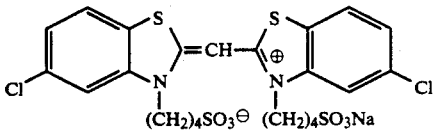

H-1

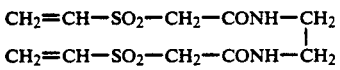

ExF-1

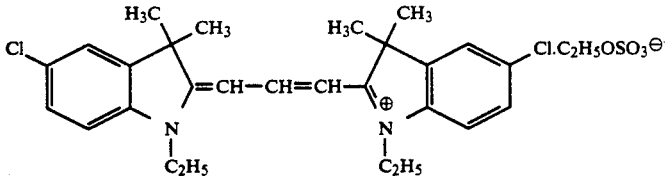

Then, silver iodobromide emulsions were prepared by changing the iodine content of those for 4th, 7th and 12th layers of Sample 201 to 7 mole % and 10 mole % respectively. One side of a substrate opposite to that which was to be coated with the foregoing emulsion layers was previously coated with gelatin in an amount of 5.0 g/m$^2$. Then, samples were prepared from these emulsions and the substrate. In this respect, a cationic polymer was added to either the gelatin layer or 5th layer of Samples of the present invention. The layer structures of these Samples 202 to 206 were shown in Table II. Samples 201 to 206 thus produced were image-wise exposed to light and then were processed according to the following processes. The processing was continued until the cumulative amount of replenisher for color developing solution reached 3 times the volume of the tank.

| Process | Processing time (sec.) | Processing temp. (°C.) | Volume of tank (l) | Amount (*) replenished |
|---|---|---|---|---|
| Color Development | 195 | 38 | 0.7 | 45 ml |
| Bleaching | 60 | 38 | 0.7 | 20 ml |
| Bleaching-fixing | 195 | 38 | 0.7 | 30 ml |
| Water washing (1) | 40 | 35 | 0.7 | two-stage counter-current water washing |

-continued

| Process | Processing time (sec.) | Processing temp. (°C.) | Volume of tank (1) | Amount (*) replenished |
|---|---|---|---|---|
| Water washing (2) | 60 | 35 | 0.7 | 30 ml |
| Stabilization | 40 | 35 | 0.7 | 20 ml |

(*) The amount replenished per unit length (1 m) of the light-sensitive material having 35 mm wide. In this connection, the overflow from the bleaching bath was introduced into the bleaching-fixing bath.

In the foregoing processes, water washing (1) and (2) were carried out by countercurrent water washing system. The composition of each processing solution used in the processing (II) was as follows:

| Color Developing Solution Component | Tank Soln. (g) | Replenisher (g) |
|---|---|---|
| Diethylenetriaminepentaacetic acid | 1.0 | 1.1 |
| 1-Hydroxyethylidene-1,1-diphosphoric acid | 2.0 | 2.2 |
| Sodium sulfite | 4.0 | 4.4 |
| Potassium carbonate | 30.0 | 32.0 |
| Potassium bromide | 1.4 | 0.7 |
| Potassium iodide | 1.3 (mg) | — |
| Hydroxylamine | 2.4 | 2.6 |
| 4-(N-ethyl-N-beta-hydroxyethylamino)-2-methylaniline sulfate | 4.5 | 5.0 |
| Water | to 1 liter | 1 liter |
| pH | 10.00 | 10.05 |

| Bleaching solution Component | Tank Soln. & Replenisher (g) |
|---|---|
| Ammonium bromide | 100 |
| Ferric ammonium ethylenediamine-tetraacetate | 120 |
| Disodium ethylenediaminetetraacetate | 10.0 |
| Ammonium nitrate | 10.0 |
| Bleaching accelerator | 2.0 |
| Aqueous ammonia | 17.0 (ml) |
| Water | to 1 liter |
| pH | 6.5 |

| Bleaching-fixing Solution Component | Tank Soln. (g) | Replenisher (g) |
|---|---|---|
| Ammonium bromide | 50.0 | — |
| Ferric ammonium ethylenediamine-tetraacetate | 50.0 | — |
| Disodium ethylenediaminetetraacetate | 5.0 | 1.0 |
| Ammonium nitrate | 5.0 | — |
| Sodium sulfite | 12.0 | 20.0 |
| 70% Aqueous ammonium thiosulfate solution | 240 (ml) | 400 (ml) |
| Aqueous ammonia | 10.0 (ml) | — |
| Water | to 1 liter | 1 liter |
| pH | 7.3 | 8.3 |

Washing Water (Tank Soln. and Replenisher)

Tap water was passed through a mixed bed type column packed with an H-type strong acidic cation exchange resin (available from MITSUBISHI CHEMICAL INDUSTRIES LTD. under the trade name of Diaion SK-1B) and an OH-type strong basic anion exchange resin (available from the same company under the trade name of Diaion SA-10A) to obtain water having the following properties and then 20 mg/l of sodium dichloroisocyanurate was added thereto as an antibacterial agent:

| | |
|---|---|
| Calcium ions | 1.1 mg/l |
| Magnesium ions | 0.5 mg/l |
| pH | 6.9 |

| Stabilization Solution Component | Tank Soln. (g) | Replenisher (g) |
|---|---|---|
| 37% (w/v) Formalin | 2.0 (ml) | 3.0 (ml) |
| Polyoxyethylene-p-mononyl phenyl ether (average degree of polymerization = 10) | 0.3 | 0.45 |
| Water | to 1 liter | |

After continuous processing described above, non-exposed samples and exposed (amount of light exposed: 100 Lwx, for 1 second) samples prepared from each Samples were processed so as to determine the amount of remaining silver and color density of each Sample as well as the fixing rate (the non-exposed samples). The desilvering rate and the color development rate (the exposed samples) were also determined.

The compositions and the observed properties of the light-sensitive materials are summarized in Table II. In Samples 210 and 211, the polymer having cationic sites was added to 3rd layer thereof. In addition, the iodide ion concentration in the bleaching-fixing bath after the continuous processing is expressed as that of $NH_4I$.

As is obvious from the results listed in Table II, the light-sensitive materials (inclusive of both non-exposed and exposed samples) of the present invention provide images having low amount of remaining silver and high color density compared with Comparative Samples.

TABLE II

| Sample No. | Iodine Content in the Emulsion for 4, 7, 12th Layers (mole %) | Cationic Polymer Added to 5th Layer (Amount) | Cationic Polymer Added to Gelatin of Opposite side (Amount added) |
|---|---|---|---|
| 201(*) | 4.0 | — | — |
| 202(*) | 5.0 | — | — |
| 203(*) | 7.0 | — | — |
| 204 | 7.0 | illustrated compound II (0.5) | — |
| 205 | 7.0 | illustrated compound II (5.0) | — |
| 206 | 7.0 | illustrated compound IV (0.5) | — |
| 207 | 7.0 | illustrated compound IV (5.0) | — |
| 208 | 7.0 | — | illustrated compound II (0.5) |
| 209 | 7.0 | — | illustrated compound II (5.0) |
| 210 | 7.0 | illustrated compound II (0.5) | — |
| 211 | 7.0 | illustrated compound II (5.0) | — |
| 212(*) | 10.0 | — | — |
| 213 | 10.0 | illustrated compound II (0.5) | — |
| 214 | 10.0 | illustrated compound II (5.0) | — |
| 215 | 10.0 | — | illustrated compound II (0.5) |
| 216 | 10.0 | — | illustrated compound II (5.0) |

| | Amount of Iodide Ion in Bleaching | Amount of Remaining Silver in | Amount of Remaining Silver in |
|---|---|---|---|

TABLE II-continued

| Sample No. | Fixing Soln. After Continuous Processing (g/l) | Nonexposed Sample (μg/cm²) | Exposed Sample (μg/cm²) | Color Density |
|---|---|---|---|---|
| 201(*) | 0.60 | 1.4 | 5.8 | 2.03 |
| 202(*) | 0.77 | 1.5 | 6.4 | 1.95 |
| 203(*) | 0.84 | 1.8 | 7.1 | 1.91 |
| 204 | 0.36 | 0.8 | 3.7 | 2.38 |
| 205 | 0.10 | 0.1 | 0.2 | 2.51 |
| 206 | 0.33 | 0.8 | 3.3 | 2.40 |
| 207 | 0.09 | 0.0 | 0.1 | 2.55 |
| 208 | 0.35 | 0.8 | 3.2 | 2.41 |
| 209 | 0.11 | 0.1 | 0.2 | 2.52 |
| 210 | 0.42 | 0.9 | 4.5 | 2.36 |
| 211 | 0.28 | 0.1 | 0.4 | 2.48 |
| 212(*) | 1.53 | 3.2 | 12.3 | 1.83 |
| 213 | 0.81 | 1.5 | 6.5 | 2.32 |
| 214 | 0.20 | 0.1 | 0.3 | 2.48 |
| 215 | 0.85 | 1.4 | 6.3 | 2.35 |
| 216 | 0.17 | 0.1 | 0.3 | 2.47 |

(*): Comparative Examples

EXAMPLE 3

Samples 201 to 216 produced in Example 2 were continuously processed by the following processes:

| Process | Processing Time (sec.) | Processing Temp. (°C.) | Volume of Tank (l) | Amount of Replenisher |
|---|---|---|---|---|
| Color Development | 165 | 40 | 0.7 | 20 ml |
| Bleaching-fixing | 165 | 40 | 0.7 | 20 ml |
| Stabilization (1) | 45 | 35 | 0.7 | — |
| Stabilization (2) | 45 | 35 | 0.7 | — |
| Stabilization (3) | 45 | 35 | 0.7 | 20 ml |

In these processes, the amount of replenishers are expressed as that per unit length (1 m) of the processed light-sensitive material having a width of 35 mm. Moreover, the replenishment of the stabilization solution was carried out by countercurrent replenishing system from the stabilization bath (3) to (1). The composition of each processing solution was as follows:

Color Developing Solution

| Component | Tank Soln. (g) | Replenisher (g) |
|---|---|---|
| Diethylenetriaminepentaacetic acid | 1.0 | 1.1 |
| 1-Hydroxyethylidene-1,1-diphosphonic acid | 2.0 | 2.2 |
| Sodium sulfite | 4.0 | 4.4 |
| Potassium carbonate | 30.0 | 32.0 |
| Potassium bromide | 1.4 | — |
| Potassium iodide | 1.3 (mg) | — |
| Hydroxylamine | 2.4 | 2.6 |
| 4-(N-ethyl-N-beta-hydroxyethylamino)-2-methylaniline sulfate | 4.5 | 6.0 |
| Pure water | to 1 liter | 1 liter |
| pH | 10.00 | 10.25 |

Bleaching-fixing Solution

| Component | Tank Soln. & Replenisher (g) |
|---|---|
| Diethylenetriaminepenta-acetic acid | 10 |
| Ferric ammonium diethylenetriamine-pentaacetate | 80 |
| 70% Aqueous ammonium thiosulfate solution | 240 ml |

-continued

| | |
|---|---|
| Sodium sulfite | 20 |
| Bleaching accelerator | 0.8 |

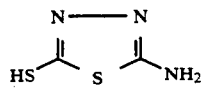

| | |
|---|---|
| Pure water | to 1,000 ml |
| pH | 6.5 |

Stabilization Solution

| Component | Tank Solution (g) |
|---|---|
| 1-Hydroxyethylidene-1,1' diphosphonic acid (60%) | 1.6 (ml) |
| Bismuth chloride | 0.35 |
| Polyvinyl pyrrolidone | 0.25 |
| Aqueous ammonia | 2.5 (ml) |
| Trisodium nitrilotriacetate | 1.0 |
| 5-Chloro-2-methyl-4-isothiazolin-3-one | 50 (mg) |
| 2-Octyl-4-isothiazolin-3-one | 50 (mg) |
| Fluorescent brightener (4,4'-diamino-stilbene type) | 1.0 |
| Polyoxyethylene-p-monononyl phenyl ether (average degree of polymerization = 10) | 0.3 |
| Pure water | to 1,000 (ml) |
| pH | 7.5 |

In this Example, excellent results were obtained as in Example 2. The results obtained are summarized in Table III below.

TABLE III

| Sample No. | Amount of Iodide Ion in Bleaching Fixing Soln. After Continuous Processing (g/l) | Amount of Remaining Silver in Nonexposed Sample (μg/cm²) | Amount of Remaining Silver in Exposed Sample (μg/cm²) | Color Density |
|---|---|---|---|---|
| 201(*) | 0.62 | 1.8 | 5.7 | 2.06 |
| 202(*) | 0.75 | 1.7 | 6.3 | 1.98 |
| 203(*) | 0.83 | 2.2 | 7.2 | 2.00 |
| 204 | 0.37 | 0.9 | 4.2 | 2.40 |
| 205 | 0.11 | 0.3 | 0.9 | 2.51 |
| 206 | 0.36 | 1.0 | 4.3 | 2.41 |
| 207 | 0.09 | 0.2 | 0.6 | 2.54 |
| 208 | 0.34 | 1.1 | 4.0 | 2.38 |
| 209 | 0.10 | 0.4 | 1.0 | 2.48 |
| 210 | 0.45 | 0.9 | 4.5 | 2.40 |
| 211 | 0.30 | 0.3 | 0.4 | 2.53 |
| 212(*) | 1.58 | 4.2 | 12.9 | 1.92 |
| 213 | 0.84 | 1.7 | 5.9 | 2.33 |
| 214 | 0.25 | 0.8 | 2.0 | 2.47 |
| 215 | 0.84 | 1.6 | 6.3 | 2.30 |
| 216 | 0.21 | 0.7 | 1.8 | 2.49 |

(*): Comparative Examples

EXAMPLE 4

A color photographic light-sensitive material (Sample 301) was produced by applying, in order, the following 1st to 14th layers onto a substrate of cellulose triacetate film.

Composition of the Light-sensitive Layer

Components and the coated amount (g/m²) of each layer are given below, provided that the coated amount of silver halide is expressed as a reduced amount of elemental silver (g/m²).

| 1st Layer: Antihalation Layer | |
|---|---|
| Black colloidal silver | 0.30 |

-continued

| | |
|---|---|
| Gelatin | 2.50 |
| Ultraviolet absorber Cpd-1,2,3 | 0.20 |
| Solvent for ultraviolet absorber Solv-1 | 0.10 |
| 2nd Layer: Intermediate Layer | |
| Gelatin | 0.50 |
| 3rd Layer: Low Sensitive Red-sensitive Emulsion Layer | |
| Silver iodobromide emulsion spectrally sensitized with red-sensitizing dye (ExS-1,2) (AgI content = 4.0 mole %; average grain size = 0.35 microns) | 0.50 |
| Gelatin | 0.80 |
| Cyan coupler ExC-1,2 | 0.25 |
| Solvent for coupler Solv-2 | 0.10 |
| 4th Layer: Moderate Sensitive Red-sensitive Emulsion Layer | |
| Silver iodobromide emulsion spectrally sensitized with red-sensitizing dye (ExS-1,2) (AgI content = 2.5 mole %; average grain size = 0.45 microns) | 0.50 |
| Gelatin | 1.00 |
| Cyan coupler ExC-1,2 | 0.50 |
| Solvent for coupler Solv-2 | 0.20 |
| 5th Layer: High Sensitive Red-sensitive Emulsion Layer | |
| Silver iodobromide emulsion spectrally sensitized with red-sensitizing dye (ExS-1,2) (AgI content = 2.5 mol %; average grain size = 0.60 microns) | 0.30 |
| Gelatin | 0.70 |
| Cyan coupler ExC-1,2 | 0.30 |
| Solvent for coupler Solv-2 | 0.12 |
| 6th Layer: Intermediate Layer | |
| Gelatin | 1.0 |
| Color mixing inhibitor Cpd-4 | 0.1 |
| Solvent for color mixing inhibitor Solv-1,2,3 | 0.25 |
| Polymer latex Cpd-5 | 0.25 |
| 7th Layer: Low Sensitive Green-sensitive Emulsion Layer | |
| Silver iodobromide emulsion spectrally sensitized with green-sensitizing dye (ExS-3,4) (AgI content = 3.0 mole %; average grain size = 0.3 microns) | 0.65 |
| Gelatin | 1.50 |
| Magenta coupler ExM-1,2 | 0.35 |
| Solvent for coupler Solv-2 | 0.30 |
| 8th Layer: High Sensitive Green-sensitive Emulsion Layer | |
| Silver iodobromide emulsion spectrally sensitized with green-sensitizing dye (ExS-3,4) (AgI content = 2.5 mole %; average grain size = 0.8 microns) | 0.70 |
| Gelatin | 1.00 |
| Magenta coupler ExM-3 | 0.25 |
| Antidiscoloration agent Cpd-6,7 | 0.15 |
| Solvent for antidiscoloration agent Solv-2 | 0.05 |
| 9th Layer: Intermediate Layer | |
| Gelatin | 0.50 |
| 10th Layer: Yellow Filter Layer | |
| Yellow colloidal silver | 0.10 |
| Gelatin | 1.00 |
| Color mixing inhibitor Cpd-4 | 0.05 |
| Solvent for color mixing inhibitor Solv-1,2 | 0.10 |
| Polymer latex Cpd-5 | 0.10 |
| 11th Layer: Low Sensitive Blue-sensitive Emulsion Layer | |
| Silver iodobromide emulsion spectrally sensitized with blue-sensitizing dye (ExS-5) (AgI content = 2.5 mole %; average grain size = 0.7 microns) | 0.55 |
| Gelatin | 0.90 |
| Yellow coupler ExY-1 | 0.50 |
| Solvent for coupler Solv-2 | 0.10 |
| 12th Layer: High Sensitive Blue-sensitive Emulsion Layer | |
| Silver iodobromide emulsion spectrally sensitized with blue-sensitizing dye (ExS-5) (AgI content = 2.5 mole %; average grain size = 1.5 microns) | 1.00 |
| Gelatin | 2.00 |
| Yellow coupler ExY-1 | 1.00 |
| Solvent for coupler Solv-2 | 0.20 |
| 13th Layer: Ultraviolet Absorbing Layer | |
| Gelatin | 1.50 |
| Ultraviolet absorber Cpd-1,2,3,8 | 0.40 |
| Solvent for ultraviolet absorber Solv-1 | 0.30 |
| Irradiation inhibiting dye Cpd-9 | 0.10 |
| 14th Layer: Protective Layer | |
| Fine grain silver iodobromide emulsion (AgI content - 1 mole %; average grain size = 0.05 microns) | 0.10 |
| Gelatin | 2.00 |
| Gelatin hardening agent H-1 | 0.30 |

Formulas or nomenclature of the compounds used are as follows:

ExS-1

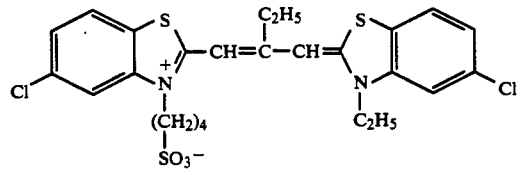

ExS-2

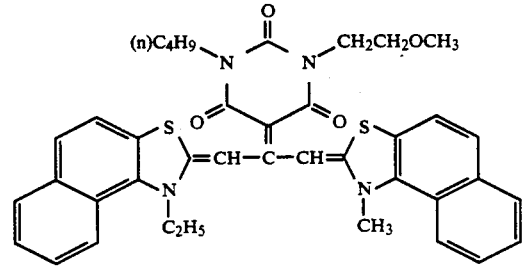

-continued
ExS-3
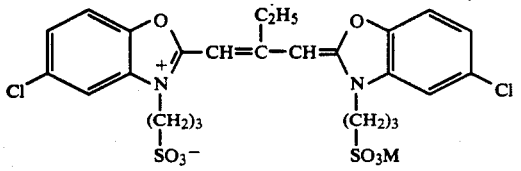
ExS-4
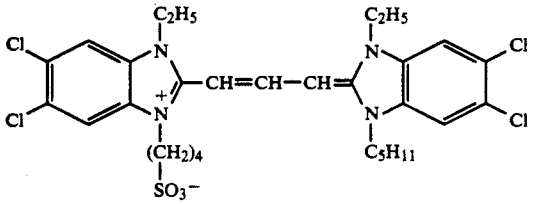
ExS-5
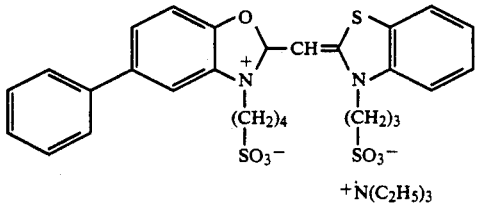
Cpd-1
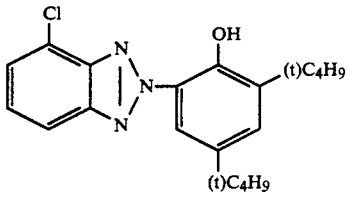
Cpd-2
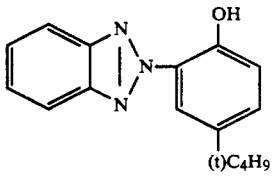
Cpd-3
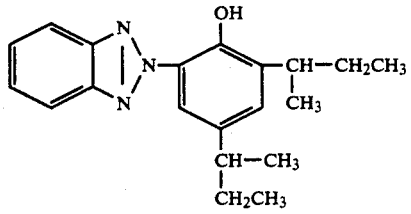
Cpd-4
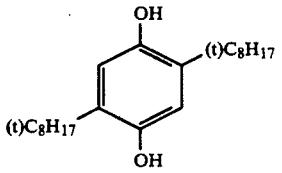
Cpd-5: Polyethyl acrylate -continued
Cpd-6
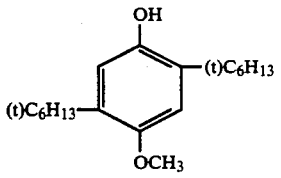
Cpd-7
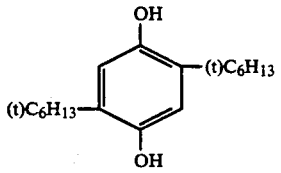
Cpd-8
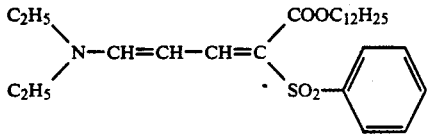
Cpd-9
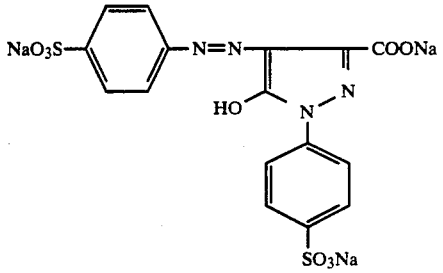
ExC-1
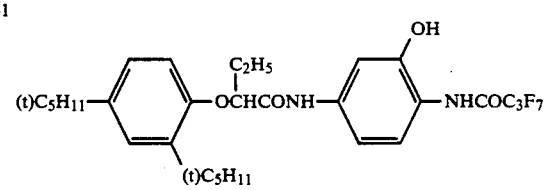
ExC-2
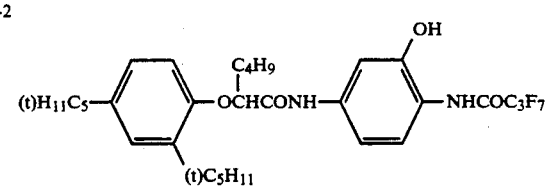
ExM-1
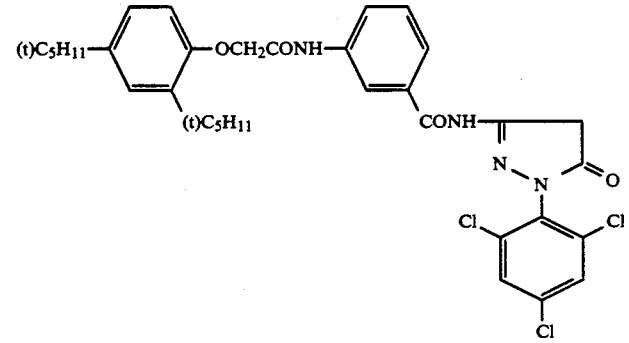

-continued

ExM-2

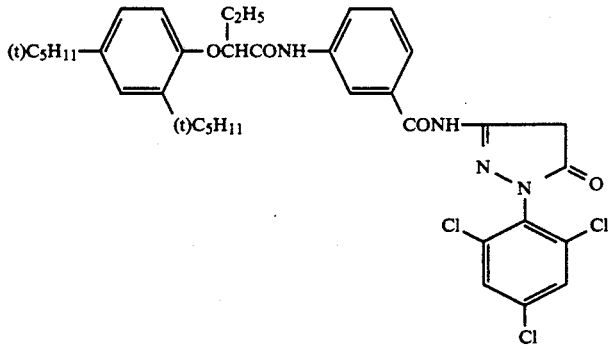

ExM-3

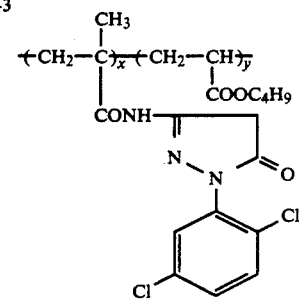

ExY-1

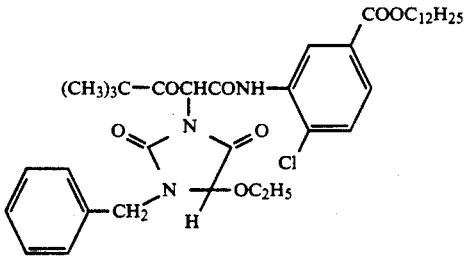

Solv-1: Dibutyl Phthalate

Solv-2: Tricresyl Phosphate

Solv-3: Trinonyl Phosphate

H-1: 1,2-Bis(vinylsulfonylacetamide)-ethane (A) Sample 302

Sample 302 was prepared from Sample 301 by changing silver iodide contents of the emulsions for 5th, 8th and 12th layers to 5 mole % respectively.

(B) Sample 303

Sample 303 was prepared from Sample 301 by changing silver iodide contents of the emulsions for 5th, 8th and 12th layers to 7 mole % respectively.

(C) Sample 308

Sample 308 was prepared from Sample 301 by changing silver iodide contents of the emulsions for 5th, 8th and 12th layers to 10 mole % respectively.

(D) The cationic polymer of the present invention was added to 2nd and 9th layers of Samples 303 and 308 to form other Samples 304–307 and 309–312. Moreover, a substrate having, on the side opposite to that to which light-sensitive layers were to be applied (hereunder referred to as "opposite side"), a gelatin layer containing cationic polymer of this invention was prepared so as to form Samples 313 and 314 as shown in Table IV.

The silver halide color photographic light-sensitive materials thus prepared were exposed to light and then processed by the following processes:

| Process | Processing Time (sec.) | Processing Temp. (°C.) |
|---|---|---|
| First Development | 360 | 38 |
| First Water Washing | 45 | 38 |
| Reversal | 45 | 38 |
| Color Development | 360 | 38 |
| Bleaching | 120 | 38 |
| Bleaching-Fixing | 240 | 38 |
| Second Water Washing (1) | 60 | 38 |
| Second Water Washing (2) | 60 | 38 |
| Stabilization | 60 | 25 |

The composition of each processing solution was as follows:

| First Developer | |
|---|---|
| Pentasodium nitrilo-N,N,N-trimethylene- | 2.0 g |

-continued

| | |
|---|---|
| phosphonate | |
| Sodium sulfite | 30 g |
| Potassium hydroquinone-monosulfonate | 20 g |
| Potassium carbonate | 33 g |
| 1-Phenyl-4-methyl-4-hydroxymethyl-3-pyrazolidone | 2.0 g |
| Potassium bromide | 2.5 g |
| Potassium thiocyanate | 1.2 g |
| Potassium iodide | 2.0 mg |
| Water | to 1,000 ml |
| pH (adjusted with the addition of HCl or KOH) | 9.60 |
| **First Washing Solution: Tank Solution** | |
| Ethylenediaminetetramethylene phosphonic acid | 2.0 g |
| Disodium hydrogenphosphate | 5.0 g |
| Water | to 1,000 ml |
| pH (adjusted with HCl or NaOH) | 7.00 |
| **Reversal Solution** | |
| Pentasodium nitrilo-N,N,N-trimethylene phosphonate | 3.0 g |
| Stannous chloride dihydrate | 1.0 g |
| p-Aminophenol | 0.1 g |
| Sodium hydroxide | 8 g |
| Glacial acetic acid | 15 g |
| Water | to 1,000 ml |
| pH (adjusted with HCl or NaOH) | 6.00 |
| **Color Developer** | |
| Pentasodium nitrilo-N,N,N-trimethylene-phosphonate | 2.0 g |
| Sodium sulfite | 7.0 g |
| Trisodium phosphate dodecahydrate | 36 g |
| Potassium bromide | 1.0 g |
| Potassium iodide | 90 mg |
| Sodium hydroxide | 3.0 g |
| Citrazinic acid | 1.5 g |
| N-Ethyl-N-(beta-methanesulfonamidethyl)-3-methyl-4-aminoaniline sulfate | 11 g |
| 3,6-Dithiaoctane-1,8-diol | 1.0 g |
| Water | to 1,000 ml |
| pH (adjusted with HCl or KOH) | 11.80 |
| **Bleaching Solution** | |
| Disodium ethylenediaminetetraacetate dihydrate | 10.0 g |
| Ferric ammonium ethylenediaminetetraacetate dihydrate | 120 g |
| Ammonium bromide | 100 g |
| Ammonium nitrate | 10 g |
| Bleaching accelerator | 0.005 moles |

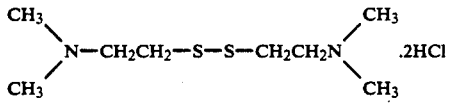

| | |
|---|---|
| Water | to 1,000 ml |
| pH (adjusted with HCl or aqueous ammonia) | 6.30 |
| **Bleaching-fixing Solution** | |
| Ferric ammonium ethylenediaminetetraacetate dihydrate | 50 g |
| Disodium ethylenediaminetetraacetate dihydrate | 5.0 g |
| Sodium thiosulfate | 80 g |
| Sodium sulfite | 12.0 g |
| Water | to 1,000 ml |
| pH (adjusted with HCl or aqueous ammonia) | 6.60 |

Second Washing Solution

This was prepared by passing tap water through a mixed bed type column packed with an H-type strong acidic cation exchange resin (available from Rohm & Haas Co. under the trade name of Amberlite IR-120B) and an OH-type anion exchange resin (available from the same company under the trade name of Amberlite IR-400) to reduce the amounts of calcium and magnesium to not more than 3 ml/l and then adding 20 mg/l of sodium dichloroisocyanurate and 1.5 g/l of sodium sulfate. PH of this solution was 6.5 to 7.5.

| Stabilization Solution | |
|---|---|
| 37% Formalin | 5.0 g |
| Polyoxyethylene-p-monononyl phenyl ether (average degree of polymerization = 10) | 0.5 g |
| Water | to 1,000 ml |
| pH | 7.20 |

The amount of remaining silver of the light-sensitive material thus processed was determined and the results obtained are summarized in Table IV together with the construction of the materials.

As seen from the results listed in Table IV, it is found that the light-sensitive material of the present invention is excellent in desilvering properties.

TABLE IV

| Sample No. | Iodine Content in 5,8,12th layer (mole %) | Cationic Polymer (added amount) | Added Layer | Remaining Silver ($\mu g/100\ cm^2$) |
|---|---|---|---|---|
| 301(*) | 2.5 | — | — | 4.3 |
| 302(*) | 5.0 | — | — | 5.4 |
| 303(*) | 7.0 | — | — | 7.9 |
| 304 | 7.0 | illustrated compound I (0.5 g) | 2.9 | 1.3 |
| 305 | 7.0 | illustrated compound I (5.0) | " | 0.1 |
| 306 | 7.0 | illustrated compound IV (0.5) | " | 1.5 |
| 307 | 7.0 | illustrated compound IV (5.0) | " | 0.1 |
| 308(*) | 10.0 | — | — | 10.4 |
| 309 | 10.0 | illustrated compound I (0.5) | 2.9 | 2.3 |
| 310 | 10.0 | illustrated compound I (5.0) | " | 0.4 |
| 311 | 10.0 | illustrated compound IV (0.5) | " | 2.4 |
| 312 | 10.0 | illustrated compound IV (5.0) | " | 0.5 |
| 313 | 10.0 | illustrated compound IV (0.5) | Gelatin layer on back side | 2.8 |
| 314 | 10.0 | illustrated compound IV (5.0) | Gelatin layer on back side | 0.5 |

What is claimed is:

1. A silver halide color photographic light-sensitive element comprising at least one silver halide emulsion layer applied onto a substrate, at least one of the layers being formed from a silver halide emulsion containing not less than 7 mole % of silver iodide, the total amount of iodine included in the silver halide emulsion layers being not less than $4\times10^3$ moles/$m^2$ expressed as AgI and an anion exchange polymer represented by the following general formula (I):

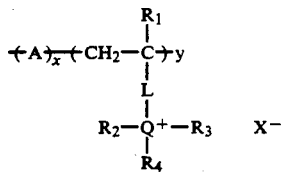

(I)

wherein A represents an ethylenically unsaturated monomer unit; $R_1$ represents a hydrogen atom, or a lower alkyl group having 1 to about 6 carbon atoms; L represents a bivalent group having 1 to about 12 carbon atoms; $R_2$ to $R_4$ may be the same or different and each represents an alkyl group having 1 to about 20 carbon atoms, an aralkyl group having 7 to about 20 carbon atoms or a hydrogen atom with the proviso that $R_2$ to $R_4$ may form a ring together with Q; Q represents a nitrogen or phosphorus atom; X represents an anion other than an iodide ion; x is 0 to about 90 mole % and y is about 10 to 100 mole %, which anion exchange polymer is added in an amount of 0.3 to 100 cationic site units per mole of total iodine in the element to at least one of the non-light-sensitive and light-sensitive layers wherein the non-light-sensitive layer is applied to the side of the substrate the same or opposite to that having the light sensitive layers.

2. A light-sensitive element according to claim 1, wherein the silver halide emulsion contains 7 to 25 mole % of silver iodide.

3. A light-sensitive element according to claim 1, wherein the silver halide emulsion layer containing silver iodide is a red-sensitive silver halide emulsion layer.

4. A light-sensitive element according to claim 1, wherein A is a monomer unit derived from styrenes, methacrylates or combination thereof; $R_1$ is a hydrogen atom or a methyl group; L is a —CO—O—$R_5$—, —CO—$NR_6$—$R_5$— or —ph—$(CH_2)_n$— wherein $R_5$ represents an alkylene, arylene or aralkylene group, $R_6$ represents a hydrogen atom or $R_2$, ph denotes a phenylene group, —$(CH_2)_n$— being bonded thereto at any position thereof, $R_2$ to $R_4$ each is an alkyl group having 1 to 12 carbon atoms, an aralkyl group having 7 to 14 carbon atoms with the proviso that at least one of these are hydrogen atoms, Q is a nitrogen atom and n is an integer of 1 or 2.

5. A light-sensitive element according to claim 1, wherein the polymer carrying cationic sites is used in the form of an aqueous polymer latex.

6. A light-sensitive element according to claim 1, wherein the polymer is added to a non-light-sensitive layer provided between the substrate and the light-sensitive layers.

7. A light-sensitive element according to claim 1, wherein the polymer is added to a non-light-sensitive layer applied to the side of the substrate opposite to that having the light-sensitive layers.

8. A light-sensitive element according to claim 1, wherein the molecular weight of the polymer is 1,000 to 1,000,000.

* * * * *